US006904253B2

(12) United States Patent
Hosokawa et al.

(10) Patent No.: US 6,904,253 B2
(45) Date of Patent: Jun. 7, 2005

(54) CHARGING MEMBER HAVING AN ELASTIC FOAM MEMBER INCLUDING CELL PORTIONS WHOSE GAP RATIO IS 5% TO 50%, CHARGING APPARATUS, PROCESS CARTRIDGE, AND IMAGE FORMING APPARATUS HAVING SUCH CHARGING MEMBER

(75) Inventors: Takahiro Hosokawa, Susono (JP); Harumi Ishiyama, Numazu (JP); Yasunori Chigono, Susono (JP); Jun Hirabayashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 10/123,248

(22) Filed: Apr. 17, 2002

(65) Prior Publication Data

US 2002/0197082 A1 Dec. 26, 2002

(30) Foreign Application Priority Data

Apr. 20, 2001 (JP) ..... 2001-122735

(51) Int. Cl.[7] ..... B03G 15/02
(52) U.S. Cl. ..... 399/176; 492/30

(58) Field of Search ..... 399/176, 174; 492/30, 53, 56, 48; 361/225

(56) References Cited

U.S. PATENT DOCUMENTS

| | | | | |
|---|---|---|---|---|
| 4,851,960 | A | 7/1989 | Nakamura et al. | 361/225 |
| 5,809,379 | A | 9/1998 | Yano et al. | 399/159 |
| 6,081,681 | A | 6/2000 | Nagase et al. | 399/174 |
| 6,128,456 | A | 10/2000 | Chigono et al. | 399/176 |
| 6,134,407 | A | 10/2000 | Ishiyama et al. | 399/174 |
| 6,289,190 | B1 | 9/2001 | Amamiya et al. | 399/174 |
| 6,553,199 | B1 | 4/2003 | Ishiyama et al. | 399/174 |

FOREIGN PATENT DOCUMENTS

| | | |
|---|---|---|
| JP | 63-149669 | 6/1988 |
| JP | 6-3921 | 1/1994 |

*Primary Examiner*—Quana M. Grainger
(74) *Attorney, Agent, or Firm*—Fitzpatrick, Cella, Harper & Scinto

(57) ABSTRACT

A charging member for charging a member to be charged, includes an elastic foam member provided at a surface of the charging member. The elastic foam member includes a plurality of cell portions with wall portion defining the cell portions. The gaps connecting the cell portions have areas which are not less than 5% and not more than 50%, for respective cells.

29 Claims, 8 Drawing Sheets

CHARGING MEMBER HAVING AN ELASTIC FOAM MEMBER INCLUDING CELL PORTIONS WHOSE GAP RATIO IS 5% TO 50%, CHARGING APPARATUS, PROCESS CARTRIDGE, AND IMAGE FORMING APPARATUS HAVING SUCH CHARGING MEMBER

FIELD OF THE INVENTION AND RELATED ART

The present invention relates to a charging member which is for charging an object such as an electrophotographic photoconductive member or an electrostatically recordable dielectric member, and has a foamed elastic portion, a charging apparatus comprising such a charging member, an image forming apparatus, such as a copying machine or a printer, employing such a charging apparatus, and a process cartridge employed by such an image forming apparatus.

In the past, in the field of an image forming apparatus, such as an electrophotographic apparatus or an electrostatic recording apparatus, a corona based charging device (corona discharger) has been widely used as a charging apparatus for uniformly charging (or discharging) an image bearing member (object to be charged), such as an electrophotographic photoconductive member or an electrostatically recordable dielectric member, to predetermined polarity and potential level.

A corona based charging device is a non-contact charging apparatus. Typically, it comprises a corona discharging electrode constituted of a piece of wire or the like, and a shield electrode surrounding the corona discharging electrode on all sides, except the side facing an image bearing member, that is, an object to be charged. In operation, it is positioned so that the open side of the shield electrode faces the image bearing member, with no contact between the charging device and the image bearing member, and high voltage is applied between the corona discharging electrode and the shield electrode, generating discharge current (corona shower). As a result, the peripheral surface of the image bearing member is exposed to the corona shower, being therefore charged to the predetermined polarity and potential level.

In recent years, a contact charging apparatus has been put to practical use because of its advantage over a corona-based charging device in terms of ozone production, electric power consumption, and the like; it is lower in ozone production and electrical power consumption compared to a corona-based charging apparatus. In order to charge an object with the use of a contact charging apparatus, the charging member of the apparatus, to which voltage is being applied as described above, is placed in contact with the object to be charged.

More specifically, in the case of a contact charging apparatus, an electrically conductive member, which is constituted of a roller (charge roller), a fur brush, a magnetic brush, a blade, or the like, is placed in contact with an object to be charged, such as an image bearing member, and a predetermined charge bias is applied to the charging member (a contact charging member, or a contact charging device, which hereinafter will be referred to as a contact charging member), so that the peripheral surface of the object to be charged is charged to the predetermined polarity and potential level.

The charging mechanism of a contact charging apparatus is a mixture of two charging mechanisms: (1) a corona-discharge-based charging mechanism and (2) a direct charge-injection mechanism. Thus, the characteristics of a contact charging apparatus reflect how dominant one charging mechanism is over the other.

(1) Electric-Discharge-Based Charging Mechanism

This is a charging mechanism in which the surface of an object to be charged is charged by the corona discharged between the minuscule gap between the contact charging member and the object to be charged.

In the case of the electrical-discharge-based charging mechanism, electrical discharge must be triggered between the contact charging member and an object to be charged, and in order to trigger electrical discharge between the contact charging member and the object to be charged, a voltage greater in potential than the starting voltage (threshold voltage) between the contact charging member and an object to be charged must be applied to the contact charging member. Therefore, in order to charge an object to a given potential level, the potential level of the voltage applied to the contact charging member must be higher than the potential level to which the object is to be charged. Further, in the case of the electrical-discharge-based charging mechanism, electrical discharge leaves byproducts. Admittedly, the amount of the byproducts from the electrical discharge in a contact charging apparatus is remarkably small compared to that from the electrical discharge in a corona based charging device. However, it is impossible, in principle, for the electrical-discharge-based charging mechanism not to leave any byproduct. Hence, it is impossible to get around the problems resulting from active ions such as ozone that are generated with this mechanism.

(2) Injection-Based Charging Mechanism

This is a charging mechanism in which the surface of an object to be charged is charged as electrical charge is directly injected from the contact charging member into the object to be charged. It is sometimes referred to as the direct charging mechanism, the injection charging mechanism, or the charge-injection charging mechanism.

To describe the injection-based charging mechanism in more detail, electrical charge is directly injected into the surface of an object to be charged, by placing a contact charging member, the electrical resistance of which is in the mid range, directly in contact with the surface of the object. In other words, in principle, the surface of the object is charged without relying on electrical discharge. Therefore, even when the potential level of the voltage applied to the contact charging member is lower than that of the starting voltage (threshold voltage) between the contact charging member and the object to be charged, the object is charged to a potential level virtually equal to the potential level of the voltage applied to the contact charging member. Since this direct charging mechanism does not involve electrical discharge, it does not generate active ions, causing no problems related to the byproducts traceable to electrical discharge.

It is, however, a mechanism which directly charges an object; its charging efficiency is greatly affected by the state of contact between a contact charging member and the object to be charged. Thus, it is necessary for a contact charging apparatus to be structured so that the surface layer of the contact charging member is as dense as possible; that the difference between the peripheral velocities of the contact charging member and the object to be charged are as large as possible; and that the frequency at which the contact charging member makes contact with the object to be charged is as high as possible.

A) Roller-Based Charging Method

In the field of a contact charging apparatus, a roller-based charging method, which employs an electrically conductive roller (charge roller) as a contact charging member, is widely used, because it is desirable in terms of safety.

In the charge-roller-based charging method, the above described electrical-discharge-based charging mechanism (1) is dominant.

A charge roller is made using a rubber-like or foamed material, which is electrically conductive or has an electrical resistance in the mid range. These materials are sometimes placed in layers to provide a charge roller with desired characteristics.

In order to maintain a predetermined state of contact with an object to be charged (which hereinafter may be referred to as a photoconductive member), the surface layer of a charge roller is made elastic, increasing therefore, the amount of the frictional resistance between the charge roller and the photoconductive member. In many cases, a charged roller is driven by a photoconductive member at the same peripheral velocity as that of the photoconductive member, or with a presence of a slight difference in peripheral velocity between the charge roller and the photoconductive member. Thus, when a charge roller is used for a contact charging mechanism, it cannot be avoided that the object to be charged is non-uniformly charged due to the loss in the absolute charging performance of the charge roller, deterioration in the state of contact between the charge roller and the object to be charged, irregularities in the surface of the charge roller, and/or foreign deposits on the peripheral surface of a photoconductive member. Therefore, in the case of a roller-type contact charging apparatus based on the prior art, the electrical-discharge-based charging mechanism is dominant.

FIG. 7 is a graph showing the charging efficiencies when typical charging members are used. The abscissa axis represents the bias applied to contact charging members, and the ordinate axis represents the potential levels to which a photoconductive member was charged.

The charging performance characteristics of the charging mechanism employing a charge roller based on the prior art is represented by a line A. As is evident from the graph, in this case, the object began to be charged as the potential level of the electrical voltage applied to the charge roller was increased past the approximate threshold voltage level of −500 V. Thus, generally, in order to charge a photoconductive member to a potential level of −500 V, a DC voltage of −1,000 V was applied to the charge roller, or an AC voltage with a peak-to-peak voltage of 1,200 V was applied, in addition to the DC voltage of −500 V, to the charge roller, so that the value of the difference in potential level between the charge roller and the photoconductive member remained greater than the value of the threshold voltage, and that the potential level of the peripheral surface of the photoconductive member converged to the intended one.

To describe this figure more concretely, for example, when the charge roller is placed in contact with a photoconductive drum with a 25 $\mu$m thick OPC layer, so that a predetermined amount of contact pressure is generated, the potential level of the peripheral surface of the photoconductive member begins to rise as the potential level of the voltage applied to the charge roller is raised past approximately 640 V, and then, the potential level of the peripheral surface of the photoconductive member linearly arises at an inclination of one, relative to the potential level of the voltage applied to the charge roller. This threshold potential level is defined as a charge starting voltage Vth.

In other words, in order to charge the peripheral surface of the photoconductive member to a potential level Vd which is necessary for electrophotography, the potential level of the DC voltage applied to the charge roller must be no less than a potential level of (Vd+Vth), which is higher than the potential level necessary for electrophotography. Hereinafter, a charging method in which an object (photoconductive member) is charged by applying only DC voltage to a contact charging member as described above will be referred to as a "DC based charging method".

With the use of a DC based charging method, however, it was difficult to charge a photoconductive member to a predetermined potential level due to the following reasons. The resistance of a contact charging member varied due to the changes in the ambient environment or the like, and the photoconductive member was shaved by the charge roller, changing the thickness of the photoconductive layer, which resulted in the change in the value of the Vth.

Therefore, the so-called AC-based charging method, such as the one disclosed in Japanese Laid-open Patent Application 63-149669, began to be used in order to more uniformly charge the peripheral surface of a photoconductive member. According to the AC-based method in this patent application, a compound voltage comprising a DC voltage, the potential level of which is equal to the potential level to which the photoconductive member is to be charged, and an AC voltage, the peak-to-peak voltage of which is no less than 2×Vth, is applied to a contact charging member. In this case, the AC voltage is applied to take advantage of the smoothing effect of the AC voltage; the potential level of the object being charged converges to the voltage level of Vd, or the voltage level corresponding to the center point between the top and bottom peaks of the AC voltage; in other words, it is not affected by external factors, for example, disturbances in the ambient environment.

However, even in the case of the above-described contact charging apparatus, in principle, its charging mechanism more or less relies on the electrical discharge from the contact charging member to the photoconductive member. Therefore, the value of the potential level of the voltage applied to the contact charging member needs to be greater than the value of the potential level to which the peripheral surface of the photoconductive member is to be charged. As a result, ozone is also generated in this case, although by only a small amount.

Further, the AC voltage applied to more uniformly charge the photoconductive member created new problems distinctive to AC voltage. That is, the application of the AC voltage generated an additional amount of ozone, and the contact charging member and the photoconductive member were vibrated by the electrical field generated by the AC voltage, generating noises (AC charge noises). Further, the peripheral surface of the photoconductive drum was deteriorated by electrical discharge.

B) Fur-Brush-Based Charging Method

In a fur-brush-based charging method, a member having a brush portion formed of electrically conductive fibers is used as a contact charging member (a fur-brush-based charging device). The electrically conductive fiber-brush portion is placed in contact with a photoconductive member as an object to be charged, and a predetermined charge bias is applied to the brush portion to charge to the peripheral surface of the photoconductive drum to predetermined polarity and potential level.

Also, this fur-brush-based charging method is dominated by the aforementioned electrical-discharge-based charging mechanism.

As for the fur-brush-based charging devices which have been put to practical use, there are two types of devices: a fixed brush-type device and rotational brush-type device. A fixed-type fur-brush-based charging device comprises an electrode, and a piece of pile fabricated by planting fibers, the electrical resistance of which is in the mid range, into a piece of substrate fabric, whereas a rotational-type fur-brush-based charging device comprises a metallic core, and a piece of pile wrapped around the metallic core. Regarding the fiber density of the aforementioned brush portion, piles with a fiber density of approximately 100 fibers/mm$^2$ can be relatively easily obtained. However, the fiber density of 100 fibers/mm$^2$ is not high enough to realize a state of contact sufficient to satisfactorily uniformly charge the photoconductive member with the use of a fur-brush-based charging method. In other words, in order to satisfactorily uniformly charge the photoconductive member with the use of a fur-brush-based charging method, the difference in peripheral velocity between the peripheral surface of the photoconductive drum and the surface of the fur brush portion must be so large that it is virtually impossible to mechanically realize. In other words, the provision of such a difference in peripheral velocity between the peripheral surface of the photoconductive drum and the surface of the fur-brush portion of the fur-brush-based charging device is unrealistic.

A typical fur-brush-based charging member displays the charging performance characteristics represented by a line B in FIG. 7 when DC voltage is applied to the aforementioned fur-brush portion of a fur-brush-type charging member.

In other words, also in the case of a fur-brush-based charging method, the photoconductive member is charged also by applying high voltage to the fur brush, in other words, using electrical discharge, whether the fur brush is of a fixed type or a rotational type.

C) Magnetic-Brush-Based Charging Method

In the magnetic-brush-based charging method, a member having a magnetic-brush portion, that is, a brush-like agglomeration of electrically conductive magnetic particles caused by the magnetism from a magnetic roll or the like, is used as a contact charging member (magnetic-brush-based charging device). The peripheral surface of a photoconductive member as an object to be charged is charged to predetermined polarity and potential level by applying a predetermined charge bias to the magnetic-brush portion of the contact charging member placed in contact with the peripheral surface of the photoconductive drum.

In the case of the magnetic-brush-based charging method, the aforementioned direct charging mechanism (2) is dominant.

As for the electrically conductive magnetic particles agglomerated to form the magnetic-brush portion, electrically conductive magnetic particles, the particle diameters of which are in a range of 5–50 $\mu$m, are used. The provision of a substantial amount of difference in velocity between the peripheral surface of a photoconductive drum and the magnetic-brush portion makes it possible to uniformly charge the peripheral surface of the photoconductive drum.

The employment of a magnetic-brush-based charging method makes it possible to charge the peripheral surface of a photoconductive drum to a potential level virtually proportional to the potential level of the bias applied to the contact charging member, as indicated by a line C in FIG. 7, which shows the charging performance characteristics of various contact charging members.

However, the magnetic-brush-based charging method has its own weakness, and suffers from problems different from those of the preceding methods. For example, it is complicated in structure. Further, there is a tendency that a certain amount of the electrically conductive magnetic particles fall out of the magnetic-brush portion and adhere to the photoconductive drum.

Japanese Laid-open Patent Application 6-3921 and the like propose a contact charging method, in which a photoconductive member is charged by injecting electrical charge directly into the portions of a photoconductive member capable of holding electrical charge, for example, the traps in the peripheral surface of a photoconductive drum, or the charge-injection layer of a photoconductive drum. This method does not rely on electrical discharge. Therefore, the potential level of the voltage necessary for charging the peripheral surface of a photoconductive drum using this method has only to be as high as the potential level to which the peripheral surface of the photoconductive drum is to be charged. Further, no ozone is generated. In addition, AC voltage is not applied, generating, therefore, no charging noises. In other words, this method is superior to the roller-based charging method in that it generates no ozone and consumes a smaller amount of electrical power compared to the roller-based charging method.

D) Toner-Recycling System (Cleanerless System)

In an image recording apparatus of a transfer type, the residual developer (toner), that is, the developer particles (toner particles) remaining on a photoconductive drum (image bearing member) after image transfer, are removed from the peripheral surface of the photoconductive drum by a cleaner (cleaning apparatus), becoming waste toner. From the standpoint of environmental protection, it is desired that no waste toner is generated. Thus, an image recording apparatus employing a toner-recycling system (toner-recycling process) has been realized. According to this system or process, the toner remaining on the peripheral surface of the photoconductive drum after image transfer is removed therefrom, and recovered, by a developing apparatus through a "developing/cleaning process". The recovered toner is used again.

The "developing/cleaning process" is a process in which the toner remaining on the peripheral surface of a photoconductive drum after image transfer is recovered using the fog prevention bias (the difference Vback between the potential level of DC voltage applied to the developing apparatus, and the potential level of the peripheral surface of the photoconductive drum), during the developing process in the following rotational cycle of the photoconductive drum, in which the photoconductive drum is charged; a latent image is formed by exposure; and the latent image is developed. According to this process, the transfer residual toner is recovered by the developing apparatus and is reused during the following developing processes. In other words, no waste toner is produced, reducing the amount of nuisance in maintenance. Further, the absence of a cleaner provides a spatial advantage, making it possible to drastically reduce the size of the image recording apparatus.

In a toner-recycling system, the transfer residual toner is not removed from the peripheral surface of the photoconductive drum by a dedicated cleaner as described before. Instead, it is sent through the charging means portion to the developing apparatus, in which it is reused for development process. Therefore, there is a problem regarding how to satisfactorily charge a photoconductive drum with the use of a contact charging method as a means for charging a photoconductive drum while toner, which is electrically insulative, is in the interface between the photoconductive drum and contact charging member. In the roller-based charging method or the fur-brush-based charging method, quite often, the pattern formed by the transfer residual toner on the photoconductive drum is eliminated by dispersing the transfer residual toner, and a large bias is applied to trigger electrical discharge in order to charge the photoconductive drum. In comparison, in the case of the magnetic-brush-based charging method, a powdery substance, which in this case is a magnetic substance in the form of particles, is used as the material for a contact charging member, or a magnetic brush. Therefore, the magnetic brush portion, or the agglomeration of electrically conductive particles, charges the photoconductive drum by coming into contact with the photoconductive drum, precisely conforming to the configuration of the peripheral surface of the photoconductive drum, which is advantageous. However, the employment of a toner-recycling system complicates the apparatus structure, and also creates a serious problem in that the electrically conductive magnetic particles forming the magnetic-brush portion fall out.

E) Method for Directly Injecting Electrical Charge (Combination of Sponge and Electrically Conductive Particles)

In a contact charging method in which electrical charge is directly injected into an object to be charged, electrical charge is made to directly transfer from a contact charging member to the object to be charged. Thus, in order to satisfactorily charge an object by directly injecting electrical charge into the object with the use of a roller-based charging method, the state of contact between the charge roller and the surface of the object to be charged need to be virtually perfect for charge injection. With the above described simple setup that the charge roller is rotated by the rotation of the photoconductive drum, it is impossible to realize such a state of contact.

In order to create the perfect state of contact for charge injection between a charge roller and the surface of an object to be charged, the charge roller must be rotated so that a substantial difference in velocity is maintained between the surfaces of the charge roller and the object to be charged, as in the case of the magnetic-brush-based charging method. However, in the case of the charge roller, or a contact charging member formed of elastic material, there is a large amount of friction between the contact charging member and the object to be charged, making it impossible to rotate the contact charging member while maintaining the substantial amount of velocity difference between the surfaces of the contact charging member and the object to be charged. Also, forcing the contact charging member to rotate under such a condition resulted in a problem that the surfaces of the contact charging member and the object to be charged were shaved.

To describe this situation more concretely, a velocity difference between the surfaces of the charging member and the object to be charged is provided by moving the surface of the charging member relative to the object to be charged. It is preferred that such a movement of the surface of the charging member is created by rotationally driving the charging member, and also that the direction in which the peripheral surface of the charging member is moved is opposite to the moving direction of the surface of the object to be charged.

The velocity difference can also be provided between the surfaces of a charging member and an object to be charged, by moving the surface of the charging member in the same direction as the moving direction of the surface of the object to be charged. However, the performance of a charging method in which electrical charge is directly injected into an object to be charged is proportional to the ratio of the surface velocity of the object to be charged, to the surface velocity of the charging member. Therefore, moving the surface of the charging member in the direction opposite to the moving direction of the surface of the object to be charged is advantageous over moving the two surfaces in the same direction, in terms of revolution, because in order to make the peripheral-velocity ratio between the charging member and the object to be charged that is realized when the peripheral surfaces of the charging member and the object to be charged are moved in the same direction equal to a given peripheral-velocity ratio between the charging member and the object to be charged that is realized when the peripheral surfaces of the charging member and the object to be charged are moved in the opposite directions, the revolution of the charging member, the peripheral surface of which is moved in the same direction as the direction in which the surface of the object to be charged moves, must be increased compared to the revolution of a charging member, the peripheral surface of which is moved in the direction opposite to the direction in which the surface of the object to be charged is moved. The above-described peripheral velocity difference is defined as follows:

peripheral-velocity ratio={(peripheral velocity of charging member−peripheral velocity of object to be charged)/peripheral velocity of object to be charged}×100 (where the peripheral velocity of the charging member assumes a positive value when the peripheral surfaces of the charging member and the object to be charged move in the same direction).

With the provision of the above-described structural arrangement, even when a charge roller or the like, which is relatively simpler in structure, is used as a contact charging member, the potential level of the bias applied to the charge roller, or a contact charging member, has only to be as high as the potential level to which the object is to be charged, making it possible to satisfactorily charge an object, without relying on electrical discharge, and therefore, making it possible to satisfactorily charge an object reliably and safely.

That is, even when a simple member, such as a charge roller or the like, is employed as a contact charging member for a contact charging apparatus, it is possible to realize a contact charging apparatus which is superior in charge uniformity performance, and is capable of directly injecting electrical charge into an object to be charged, for a long period of time; in other words, it is possible to realize a contact charging apparatus, which is simple in structure, and yet capable of satisfactorily charging an object by directly injecting electrical charge into the object, and therefore, without generating ozone, while requiring relatively low voltage as the voltage to be applied to the contact charging member.

Also with this structural arrangement, it is possible to provide an image forming apparatus or a process cartridge, which is simple in structure, and low in cost, and yet capable of uniformly charging the photoconductive member, without creating the problems traceable to ozone production or charge failure.

U.S. Pat. Nos. 6,134,407, 6,081,681, and 6,128,456 show the means for reducing the amount of the friction between a contact charging member and an object to be charged. According to them, electrically conductive particles are placed at a minimum distance between the contact charging member and the object to be charged in the nip between the contact charging member and the object to be charged, so that the friction between the contact charging member and the object to be charged is effectively reduced by the lubricous effect (friction reducing effect) of the particles.

Also, the contact charging member is provided with a low friction surface layer in order to reduce the amount of the friction between the contact charging member and the object to be charged.

The presence of the aforementioned particles at a minimum distance between the contact charging member and the object to be charged in the nip between the contact charging member and the object to be charged, reduces the amount of the friction between the contact charging member and the object to be charged. The reduction in the friction between the contact charging member and the object to be charged makes it possible to reduce the torque necessary to rotate the contact charging member, allowing the contact charging member and the object to be charged to remain in contact with each other while maintaining a greater amount of velocity difference between the surfaces of the contact charging member and the object to be charged. Further, the presence of the particles in the nip between the contact charging member and the object to be charged, improves the state of the contact between the contact charging member and the object to be charged, in the nip, in terms of density and uniformity. More specifically, the powdery substance in the nip between the contact charging member and the object to be charged fills virtually every microscopic gap present in the nip between the contact charging member and the object to be charged as it rubs the surface of the object to be charged. Therefore, electrical charge can be directly injected with a high level of efficiency, into the object to be charged. In other words, in the case of a contact charging method in which a powdery substance is placed between the contact charging member and the object to be charged, the direct injection mechanism, that is, the charging mechanism in which electrical charge is directly injected into the object to be charged, is dominant.

Therefore, charging efficiency is very high; an object can be charged to a potential level virtually equal to the potential level of the voltage applied to a contact charging member. When charging an object by moving the surface of the contact charging member formed using elastic material, relative to the surface of the object to be charged, in contact with the surface of the object to be charged, while maintaining a substantial velocity difference between the two surfaces, the initial torque necessary to drive the contact charging member can be reduced by reducing the friction between the contact charging member and the object to be charged, so that the surface of the contact charging member is allowed to move smoothly, and that the state of direct contact between the contact charging member and the object to be charged is improved in uniformity, making it possible for electrical charge to be directly and uniformly injected into the object to be charged.

Among the contact charging members based on the prior art regarding direct charge injection, which were described in the sections related to the prior art, there are contact charging members, the surfaces of which are porous like that of a sponge roller, and are coated with electrically conductive microscopic particles to improve the direct injection efficiency. In the case of these contact charging members, not only is an object to be charged through the direct contact between the object and contact charging member, but also the object is to be charged by the contact between the object and the electrically conductive microscopic particles. In other words, it is possible to make the state of contact between the contact charging member and the object to be charged, extremely dense. Therefore, the object can be satisfactorily, that is, uniformly and reliably, charged through charge injection.

Electrically conductive microscopic particles are particles for enhancing the charging performance of a contact charging member (charging-performance-enhancing particles). The electrically conductive microscopic particles (which hereinafter will be referred to as electrically conductive particles) are placed at a minimum distance between the contact charging member and the object to be charged in the nip (charging nip) between the contact charging member and an object to be charged, to reliably inject electrical charge into the object to be charged, in order to uniformly charge the object.

In other words, an object to be charged is charged by a contact charging method, with the presence of electrically conductive particles in the charging nip between the object to be charged and a contact charging member. Also with the presence of electrically conductive particles in the charging nip, not only is the object to be charged allowed to smoothly move in contact with the contact charging member due to the lubricous effect of the particles, but also the state of contact between the contact charging member and the object to be charged is improved in contact density, increasing the frequency at which the contact member makes contact with the surface of the object to be charged. As a result, the surface of the moving object is uniformly rubbed by the electrically conductive particles, in the charging nip. Therefore, the surfaces of the contact charging member and the object to be charged are kept virtually perfectly in contact with each other even at a microscopic level, while maintaining a proper amount of contact resistance, allowing electrical charge to be directly injected into the object to be charged, at a high level of efficiency and uniformity. In the case of the above-described contact charging of the object by the contact charging member, the dominant charging mechanism is the direction injection mechanism, that is, the charging mechanism in which electrical charge is directly injected into the object.

However, when the above-described charging apparatus is employed by a cleanerless image forming apparatus, that is, an image forming apparatus which does not have a dedicated cleaner, and a sponge roller, in which cells are interconnected, is employed as the charging member for the charging apparatus, the following problem occurs; as the cumulative number of copies increases, the cumulative amount of the fibrous paper dust which deposits on the sponge roller also increases, and the transfer residual toner particles agglomerate around the paper dust particles, causing the charging member to become unsatisfactory in charging performance.

On the other hand, when a sponge roller in which cells are discrete is used as the charging member of a cleanerless image forming apparatus, the following problem, which is different from the above-described one, occurs. That is, the transfer residual toner particles are quickly expelled onto the peripheral surface of a photoconductive drum, because such a sponge roller is inferior in particle retention, and therefore, fails to temporarily retain the transfer residual toner particles. As a result, the exposure light is blocked by the transfer residual toner particles on the peripheral surface of the photoconductive drum. Further, sometimes, a large amount of the transfer residual toner particles is expelled all at once from the charge roller onto the photoconductive drum. In such a case, the developing device fails to recover all the transfer residual toner particles from the peripheral surface of the photoconductive drum, and the particles which the developing apparatus failed to recover, in other words, the particles which were left on the peripheral surface of the photoconductive drum, are transferred onto a transfer medium, causing the background portion of an image to appear slightly foggy.

SUMMARY OF THE INVENTION

The primary object of the present invention is to solve the above-described problems, and provide a charging member, a charging apparatus, an image forming apparatus, and a process cartridge, which are capable of assuring satisfactory charging performance, and the production of satisfactory images.

Another object of the present invention is to provide a charging member, a charging apparatus, an image forming apparatus, and a process cartridge, which are capable of preventing foreign substances, such as paper dust, from accumulating on and in the foamed portion of the charging member.

Another object of the present invention is to provide a charging member, a charging apparatus, an image forming apparatus, and a process cartridge, which are superior in particle retention.

Another object of the present invention is to provide a charging member, a charging apparatus, an image forming apparatus, and a process cartridge, which are capable of temporarily storing transfer residual developer.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS (Embodiment 1)

Figure 1:
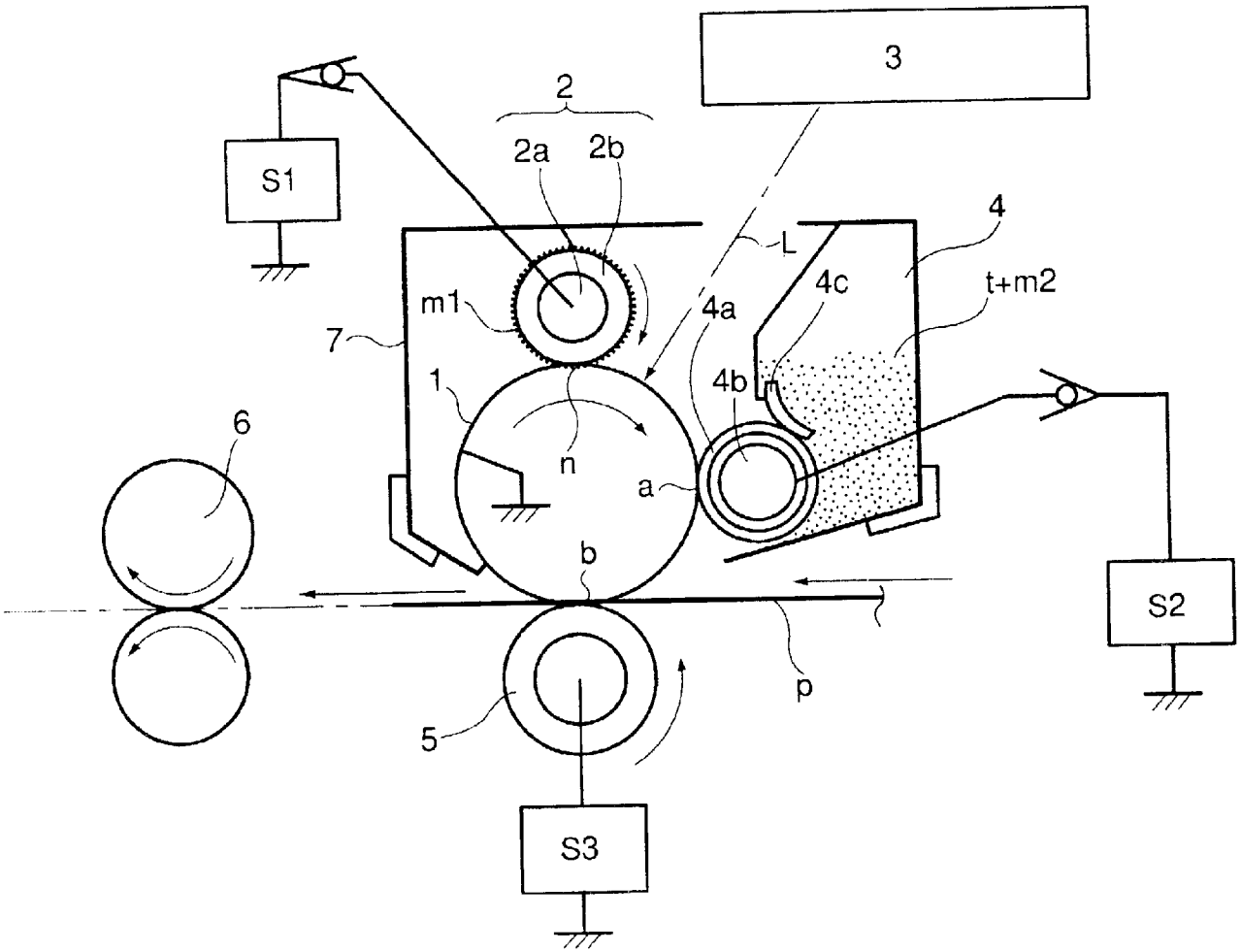
FIG. 1 is a schematic sectional view of the image forming apparatus in an embodiment of the present invention, for showing the general structure thereof.

FIG. 1 is a schematic sectional view of a typical image forming apparatus equipped with a charging member or a contact charging apparatus in accordance with the present invention, for showing the general structure thereof.

The image forming apparatus in this embodiment is a laser printer (recording apparatus) which employs a transfer-type electrophotographic process, a process cartridge mounting/dismounting system, and a contact charging system.

(1) General Structure of Printer

Reference numeral 1 stands for an object (image bearing member) to be charged. In this embodiment, it is a negatively chargeable organic photoconductive member (negative photoconductive member, which hereinafter will be referred to as a photoconductive drum), which is in the form of a rotational drum with a diameter of 30 mm. This photoconductive drum 1 is rotationally driven at a peripheral velocity (process speed: PS; printing speed) of 50 mm/sec in the clockwise direction indicated by an arrow mark.

Reference numeral 2 stands for an electrically conductive elastic roller (which hereinafter will be referred to as a charge roller), as an elastic contact charging member (contact charging device), which is placed in contact with the photoconductive drum 1 with the application of a predetermined pressure. Reference letter n stands for a charging nip, that is, the nip between the photoconductive drum 1 and the charge roller 2. The peripheral surface of the charge roller 2, which has been treated with a fluorinated chemical compound, is coated in advance with electrically conductive particles m1 (charging-performance-enhancing particles), in such a manner that the particles are allowed to freely leave the peripheral surface of the charge roller 2. The charge roller 2 and electrically conductive particles m1 will be described later.

The charge roller 2 is rotationally driven in such a direction that the moving direction of its peripheral surface in the charging nip n becomes opposite (counter) to the moving direction of the peripheral surface of the photoconductive drum 1 in the charging nip n, and that there will be a difference in peripheral velocity between the charge roller 2 and the photoconductive drum 1. To the charge roller 2, a predetermined charge bias is applied from a charge bias application power source S1.

As a result, electrical charge is directly injected into the peripheral surface of the rotating photoconductive drum 1, uniformly charging the peripheral surface of the photoconductive drum 1 to a predetermined polarity and potential level. This process will also be described later in detail.

Reference numeral 3 stands for a laser beam scanner (exposing apparatus) comprising a laser diode, a polygonal mirror, and the like. This laser beam scanner 3 outputs a beam of laser light L modulated with sequential digital electric signals reflecting the image-formation data of an intended image, so that the uniformly charged peripheral surface of the rotating photoconductive drum 1 is exposed to (scanned by) the beam of laser light L. As a result, an electrostatic latent image in accordance with the image-formation data of the intended image is formed on the peripheral surface of the rotating photoconductive drum 1.

Reference numeral 4 stands for a developing device. To developer t, electrically conductive particles m2 (charging-performance-enhancing particles) have been added. The electrostatic latent image on the peripheral surface of the photoconductive drum 1 is developed into a toner image, in the developing portion a of the developing device 4. The developing device 4 and electrically conductive particles m2 will be described later.

Reference numeral 5 stands for a transfer roller, as a contact transferring means, the electrical resistance of which is in the mid range. The transfer roller 5 is kept pressed upon the photoconductive drum 1 in the predetermined manner, forming a transfer nip b. To this transfer nip b, a transfer medium P, as a recording medium, is fed from an unshown sheet feeding portion, with a predetermined timing, and to the transfer roller 5, a predetermined transfer bias voltage is applied from a transfer-bias application power source S3. As a result, the toner image on the photoconductive drum 1 is sequentially transferred onto the surface of the transfer medium P fed into the transfer nip b. In this embodiment, the transfer roller 5 with an electrical resistance value of $5\times10^3$ Ω was used, and a DC voltage of +2,000 V was applied to the transfer roller 5, for the transfer. More specifically, after being introduced into the transfer nip b, the transfer medium P is conveyed through the transfer nip b, while remaining pinched in the transfer nip b, and as the transfer medium P is conveyed, the toner image formed and borne on the peripheral surface of the photoconductive drum 1 is sequentially transferred onto the transfer medium P by electrostatic force and pressure.

Reference numeral 6 stands for a thermal fixing apparatus or the like. After receiving the toner image from the photoconductive drum 1 while being fed through the transfer nip b, the transfer medium P is separated from the peripheral surface of the rotating photoconductive drum 1, and is introduced into the fixing apparatus 6, in which the toner image is fixed to the recording medium P. Then, the recording medium P is discharged as a finished copy (print) from the image forming apparatus.

The printer in this embodiment is of a cleanerless type. Thus, the transfer residual toner, that is, the toner remaining on the peripheral surface of the rotating photoconductive drum 1 after the transfer of the toner image onto the transfer medium p, is not removed by a dedicated cleaner (cleaning apparatus). Instead, it is allowed to reach the developing portion a through the charging nip n, as the photoconductive drum 1 rotates. Then, it is recovered by the developing device 4 at the same time as the latent image is developed in the developing portion a toner-recycling process).

(2) Charge Roller 2

The charge roller 2 as the contact charging member in this embodiment comprises a metallic core 2*a*, as a member functioning as an electrode, and an elastic layer 2*b* functioning as an elastic portion. The elastic layer 2*b* is formed of foamed urethane, in which carbon particles have been dispersed, and the electrical resistance of which is in the mid range. In the foamed elastic portion, cells are randomly connected to only some of the adjacent cells.

Hereinafter, the structure of the foamed material used as the material for the elastic layer of the charge roller 2 in this embodiment will be described in detail.

Figure 8:
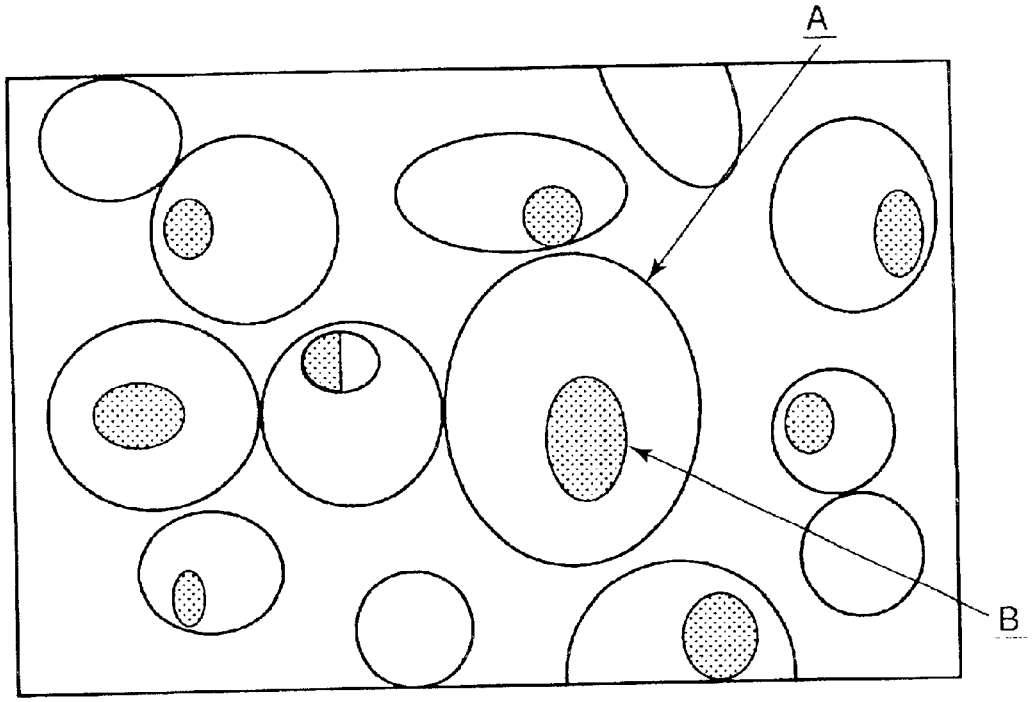
FIG. 8 is an enlarged view of the surface of the charging member in the embodiment of the present invention.

FIG. 8 is an enlarged view of the surface of the charging member in this embodiment, which was obtained by SEM photography or the like. From the photograph of the magnified surface of the charging member, 100 cells are picked in order of size, starting from the largest one, and the projected area A of each cell, and the projected area B of the gap (passage connecting a cell to another cell), are measured. Then, the ratio between values of the projected areas A and B is calculated. This ratio is obtained for all of the selected 100 cells. Then, the obtained ratios for 100 cells are averaged:

gap ratio of each cell=(projected area B of gap/projected area A of each cell)×100

The values of the gap ratios of 100 cells are averaged (average gap ratio).

In the case of the foamed material used in this embodiment, this gap ratio was kept within a range of 5%–50%. When the average gap ratio of a foamed material is no less than 5%, the foamed material is superior in particle retention, whereas when the average gap ratio of a foamed material is no more than 50%, the foamed material has a relatively small number of interconnections, being therefore capable of preventing paper dust from entering the foamed material.

Hereinafter, a foamed material which is no less than 5% and no more than 50% in average gap ratio will be referred to "foamed material in which cells are randomly connected to only some of the adjacent cells".

Next, the effects of the present invention will be concretely described with reference to the schematic drawings in FIGS. 4–6.

Figure 4:
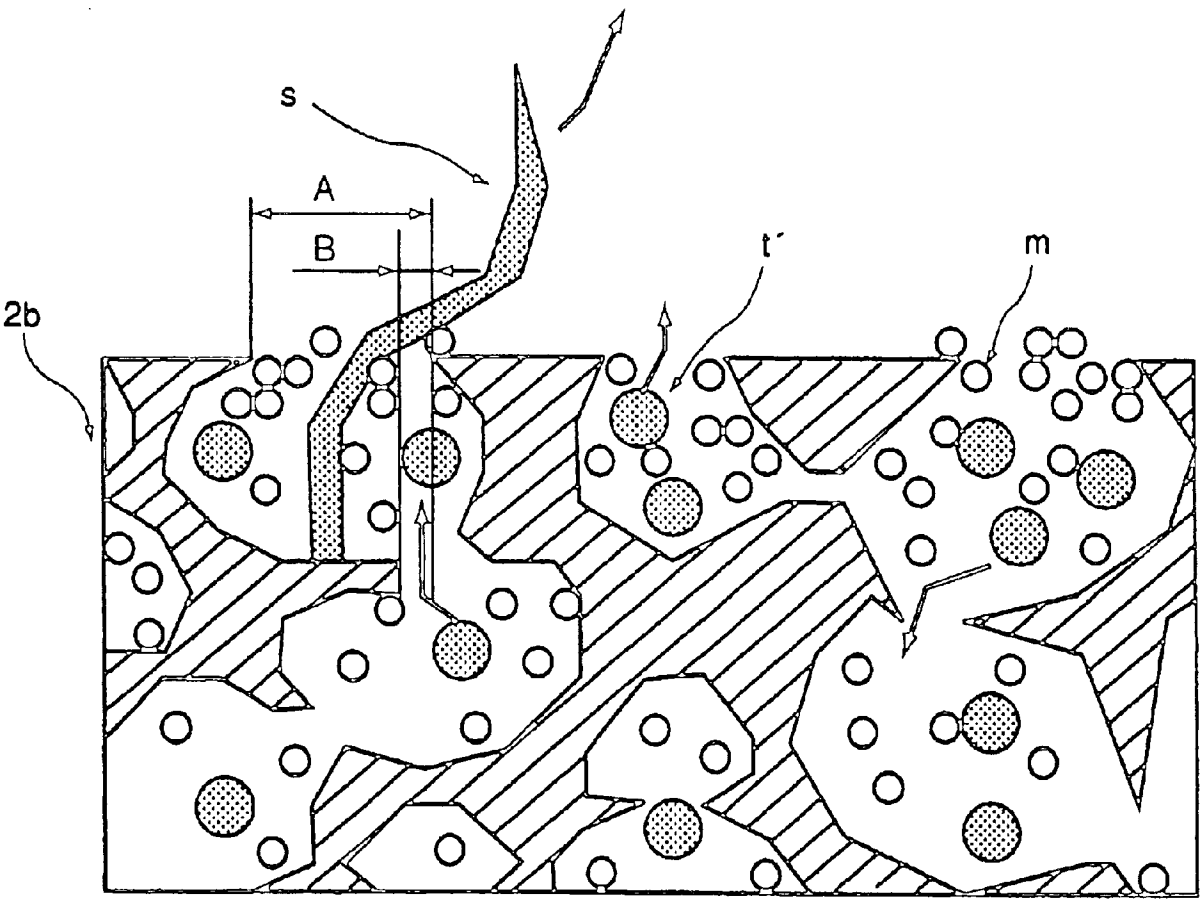
FIG. 4 is an enlarged schematic sectional view of the foamed elastic portion of the charging member, in which cells are randomly connected to only some of the adjacent cells, for showing the manner in which particles are taken into the foamed elastic portion, or expelled therefrom.

(A) FIG. 4 is a schematic sectional view of the foamed elastic portion of the charging member (charge roller), in which cells are randomly connected to only some of the adjacent cells, and shows the manner in which paper dust particles s and transfer residual toner particles t' are taken into the foamed elastic portion, or expelled therefrom.

As shown in FIG. 4, the foamed elastic portion 2*b* in which cells are randomly connected to only some of the adjacent cells, shows the characteristics of foamed material in which all cells are discrete. Therefore, the paper dust s, which is in the form of a piece of filament, is not allowed to invade deep into the foamed elastic portion 2*b*. Thus, even when the paper dust s is allowed to invade into the foamed elastic portion 2*b*, most of it remains at, or in the portion close to the surface of the foamed elastic portion 2*b*. Therefore, the paper dust s is expelled from the foamed elastic portion 2*b* immediately after the transfer residual toner particles t' are expelled from the foamed elastic portion 2*b*.

On the other hand, this foamed elastic portion 2*b* also displays the characteristics of foamed material in which cells are interconnected, allowing the particles to enter deep into the foamed elastic portion 2*b*. Thus, the foamed elastic portion 2*b* is capable of temporarily storing the transfer residual toner particles t' and gradually expelling them onto the object to be charged (photoconductive member).

Figure 5:
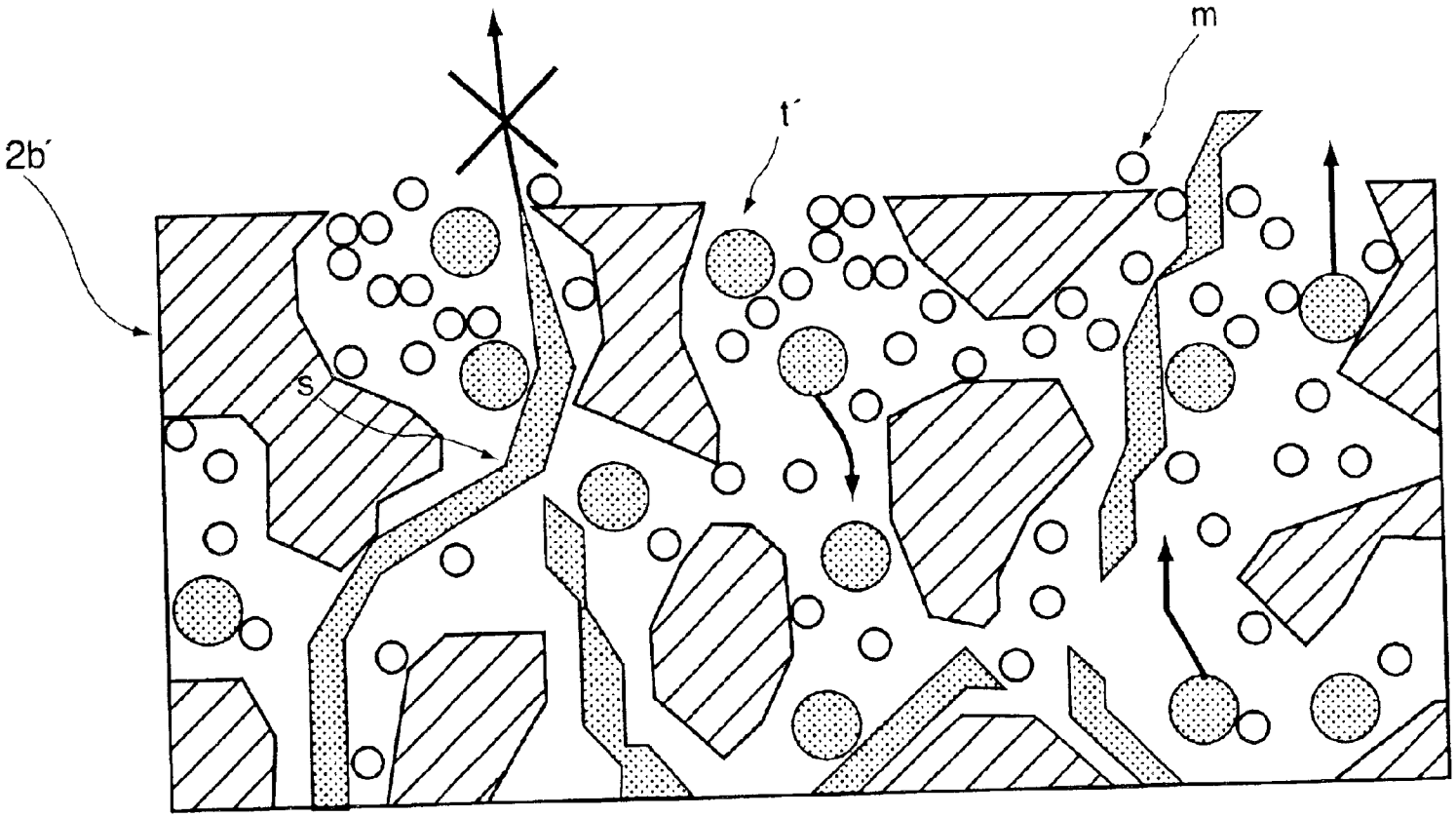
FIG. 5 is an enlarged schematic sectional view of the foamed elastic portion of the charging member, in which cells are randomly interconnected, for showing the manner in which particles are taken into the foamed elastic portion, or expelled therefrom.

(B) FIG. 5 is a schematic sectional view of the foamed elastic portion 2*b*', that is, a comparative example, of the charging member, in which cells are interconnected, and shows the manner in which paper dust particles s and transfer residual toner particles t' are taken into the foamed elastic portion 2*b*', or expelled therefrom.

As shown in FIG. 5, this foamed elastic portion 2*b*' does not display the characteristics of foamed material in which all cells are discrete. Thus, as the paper dust s is taken into the foamed elastic portion 2*b*', it enters deep into the foamed elastic portion 2*b*', preventing the foamed elastic portion 2*b*' from expelling it. However, the cells in this foamed elastic portion 2*b*' are interconnected, providing the foamed elastic portion 2*b*' with a higher level of particle retaining ability. Thus, this foamed elastic portion 2*b*' is capable of temporarily storing the transfer residual toner particles t' and gradually expelling them onto the object to be charged.

Figure 6:
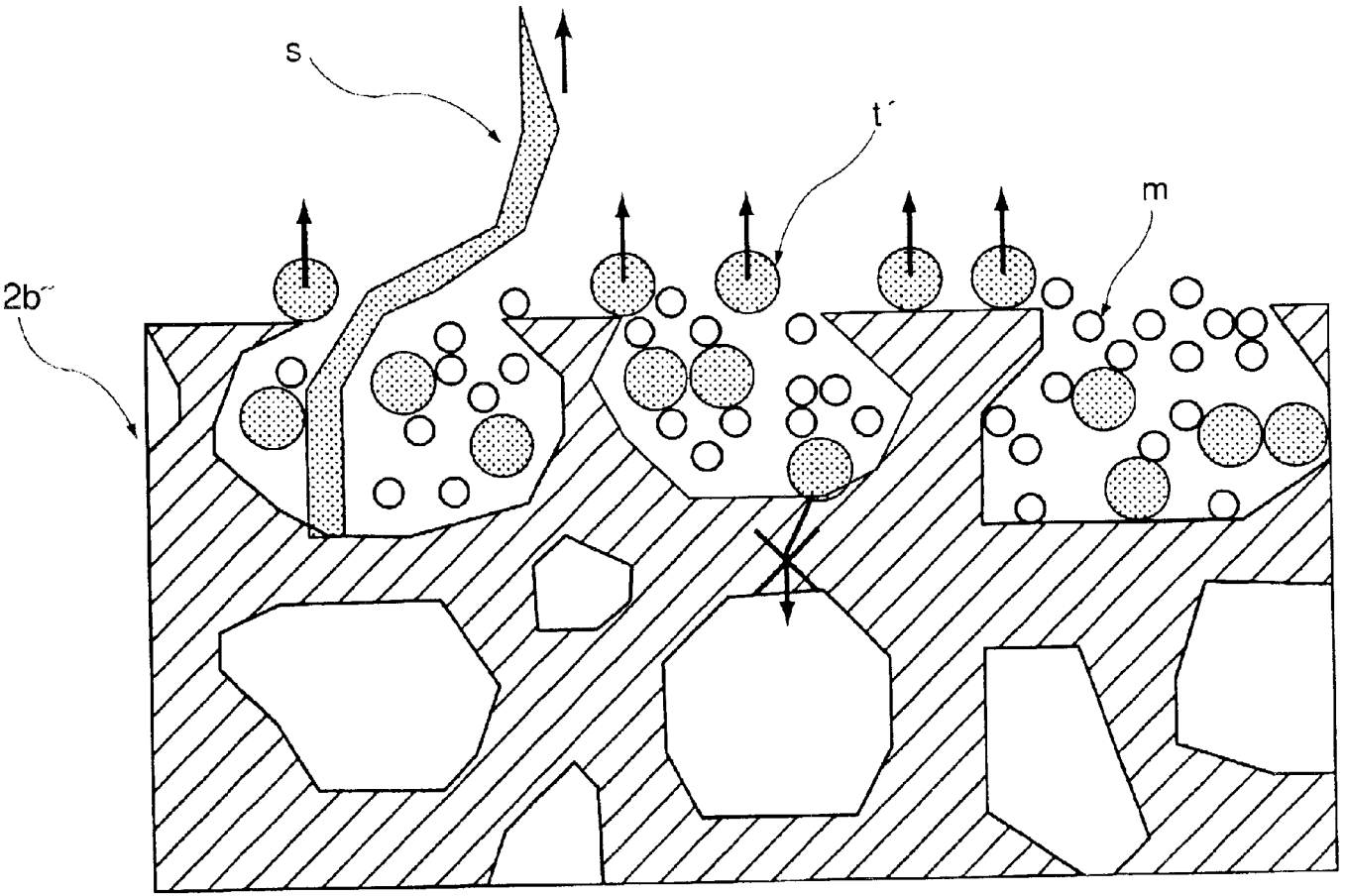
FIG. 6 is an enlarged schematic sectional view of the foamed elastic portion of the charging member, in which cells are discrete, for showing the manner in which particles are taken into the foamed elastic portion, or expelled therefrom.
Figure 7:
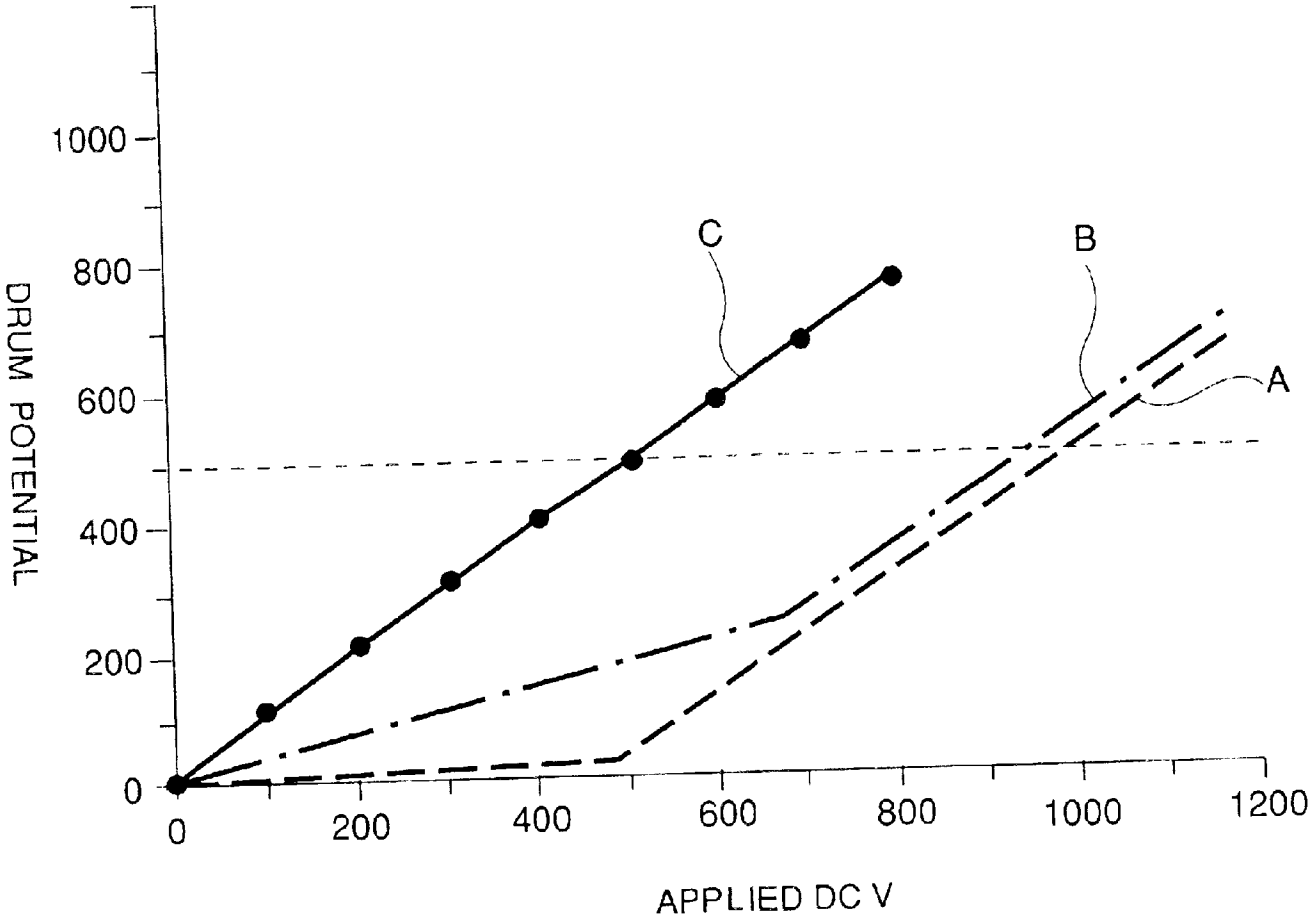
FIG. 7 is a graph for showing the characteristics of the charging members in terms of charging performance.

(C) FIG. 6 is a schematic sectional view of the foamed elastic portion 2*b*", that is, another example, of the charging member, in which cells are discrete, and show the manner in which the paper dust s and transfer residual toner particles t' are taken into the foamed elastic portion 2*b*", or expelled therefrom.

As shown in FIG. 6, in this foamed elastic portion 2*b*", cells are discrete. Therefore, the paper dust s, which is in the form of a filament, cannot enter deep into the foamed elastic portion 2*b*". Thus, even when the paper dust s is taken into the foamed elastic portion 2*b*", it is expelled from the foamed elastic portion 2*b*" immediately after the transfer residual toner particles t' are expelled from the foamed elastic portion 2*b*.

However, this foamed elastic portion 2*b*" does not display at all the characteristics of foamed material in which cells are interconnected. Thus, it is inferior in particle retention. Therefore, it cannot temporarily store the transfer residual toner particles t'; in other words, the transfer residual toner particles t' are expelled from the foamed elastic portion 2*b*" all at once onto the object to be charged.

As will be evident from the descriptions given above, the employment of the charging member, in the foamed elastic portion 2*b* of which cells are connected to only some of the adjacent cells, solves one of the problems of the foamed elastic portion 2*b*' in which cells are interconnected, that is, the problem that the object to be charged, is unsatisfactorily charged due to the interference from the paper dust s in the form of a filament. Therefore, even during a long printing operation, the charging member does not store the fibrous paper dust s, and therefore, images that do not suffer from defects traceable to unsatisfactory charging of the photoconductive member are produced.

Further, the employment of the foamed elastic portion 2*b* in which cells are connected to only some of the adjacent cells, as the elastic portion of a charging member, solves other problems of the charging member employing, as the elastic portion, the foamed elastic portion 2*b*' in which cells are interconnected, that is, the problems that the transfer residual toner particles t' expelled from the charge roller block the exposing light, and that fog is generated by the transfer residual toner particles t'. Therefore, even during a long printing operation, satisfactory images, that is, images that do not suffer from defects traceable to the expelled transfer residual toner particles t', can be produced.

Regarding the properties of the foamed elastic layer of a charging member, the foamed elastic layer of a charging member is desired to pass the following test: a 25 mm long piece, in terms of the axial direction of the charge roller 2, is cut as a test piece from the foamed elastic layer 2*b*. One end of the test piece, in terms of its axial direction, is exposed to the ambient environment, and the other end is connected to a chamber, the internal pressure of which is kept 100 mmHg (13.3 kPa) lower than the atmospheric pressure. Then, whether or not the quantity of the air flow through the test piece is no less than 1 cc/cm$^2$ min and no more than 100 cc/cm$^2$ min is tested. When the air flow quantity of the foamed elastic layer of a charge roller is no more than 1 cc/cm$^2$ min, virtually no surface cells of the charging member are connected to the cells in their adjacencies. Therefore, the charge roller is inferior in particle retaining ability. Thus, the charge roller cannot temporarily store the transfer residual toner particles, immediately expelling them onto the photoconductive member. Therefore, the exposing light is blocked by the expelled transfer residual toner particles during an exposing process. Further, the developing device is likely to fail to recover all of the large amount of the transfer residual toner particles expelled all at once onto the photoconductive member. Therefore, the non-image area of the transfer medium is likely to sustain fog traceable to the transfer residual toner particles. On the other hand, when the quantity of the air flow through the foamed elastic layer of a charge roller is no less than 100 cc/cm$^2$ min, a substantial number of the cells in the elastic layer of the charge roller are interconnected, allowing the paper dust to enter the charging member. As a result, the amount of the fibrous paper dust in the spongy charge roller gradually increases. Further, the transfer residual toner particles agglomerate, with the paper dust acting as a nucleus, being likely to cause the photoconductive member to be unsatisfactorily charged.

Figure 2:
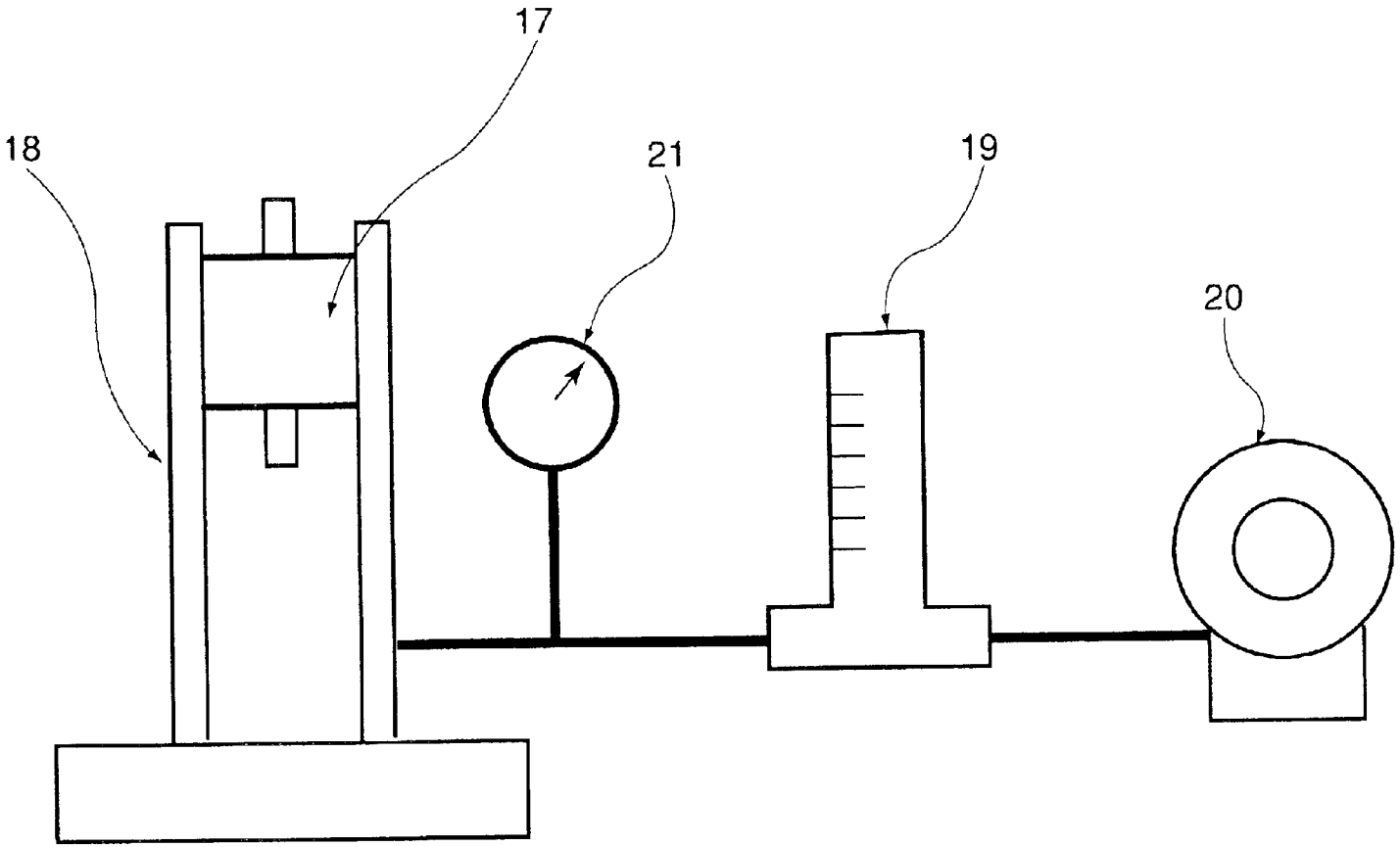
FIG. 2 is a schematic drawing for showing how to measure the quantity of air flow through the foamed elastic portion of the charging member.

To describe this aspect of the invention more concretely, the quantity of the air flow through the foamed elastic material, such as the above-described material for the elastic layer of a charging member, is measured by an apparatus structured as shown in FIG. 2, in the following manner. That is, first, a charge roller 2 comprising a foamed elastic layer 2*b* is fabricated. Then, a 25 mm long piece, in terms of the axial direction of the charge roller 2, is cut, as a test piece 17, from the foamed elastic portion 2*b*. Next, the test piece 17 is pressed into a cylinder 18, the internal diameter of which is slightly smaller than the external diameter of the charge roller 2. Then, one end of the cylinder 18 is left exposed to the ambient environment, whereas the other end is connected to a vacuum pump gauge 21, which is also called a pressure gauge, with the interposition of an air-flow meter 19. Next, the amount of air which flows through the test piece 17 is measured by the air-flow meter 19, while operating the vacuum pump 20, measuring the internal pressure of the portion of the cylinder 18 on the side connected to the vacuum pump 20, with the use of the pressure gauge 21, so that the internal pressure is kept 100 mHg lower than the atmospheric pressure. Then, the measured amount of the air flow is divided by the cross sectional area of the test piece 17 to obtain the quantity of air flow through the charge roller. The quantity of air flow through the charge roller in this embodiment was 13 cc/cm$^2$ min.

This charge roller 2 has been coated with electrically conductive particles m1 (charging-performance-enhancing particles), in a manner that the particles are allowed to freely move.

In order to form the foamed elastic layer, the electrical resistance of which is in the mid range, a reactive foaming material is produced by mixing a cross-linking agent, a foaming agent (water, a substance with a low boiling point, a gaseous substance, or the like), a surfactant, catalyst, and the like, into urethane material, in known proportions in which the structure of the foamed elastic layer, into which the mixture will be formed, is likely to form cells that are connected to only some of the adjacent cells. Further, in order to give the charge roller a desired level of electrical conductivity, electrically conductive particles (for example, carbon black) are mixed into the above-described reactive mixture, or the material for the foamed elastic layer. The thus produced material is guided into a mold, and is made to foam therein, forming the foamed elastic layer 2*b*, in the form of a roller, in which cells are connected to only some of the adjacent cells, around the metallic core 2*a*. Thereafter, the peripheral surface of the foamed elastic layer 2*b* is polished as necessary, effecting a charger roller 2, or an electrically conductive elastic roller, which is 12 mm in diameter and 200 mm in length.

The measured electrical resistance of the charge roller 2 in this embodiment was 100 kΩ, which was obtained in the following manner: the charge roller 2 was kept pressed upon an aluminum drum having a diameter of 30 mm, so that a total pressure of 1 kg (9.8 N) was applied to the metallic core 2*a* of the charge roller 2. Then, the electrical resistance of the charge roller 2 was measured while applying 100 V between the metallic core 2*a* and the aluminum drum.

It is very important that the charge roller 2 as a contact charging member functions as an electrode. In other words, not only is it necessary that the charge roller 2 is given a sufficient amount of elasticity in order to realize as ideal as possible a state of contact between the charge roller 2 and an object to be charged, but also it is necessary that the electrical resistance of the charge roller 2 is low enough to satisfactorily charge the moving object. On the other hand, the charge roller 2 must be capable of preventing a voltage leak, when the object to be charged has defective portions in terms of electrical insulation, for example, a pinhole. Thus, when the object to be charged is an electrophotographic photoconductive member, the electrical resistance of the charge roller 2 is desired to be in a range of $10^4$–$10^7$ Ω, so that the charge roller 2 is provided with a satisfactory charging performance as well as a satisfactory amount of electrical resistance for preventing an electrical leak.

As for the hardness of the charge roller 2, if it is too low, the charge roller 2 is unstable in shape, failing to remain properly in contact with the object to be charged, whereas if it is too high, not only does the charge roller 2 fail to form a charging nip of a proper size with the object to be charged, but also fails to properly contact the surface of the object to be charged, at a microscopic level. Therefore, the hardness of the charge roller 2 is desired to be in a range of 25 degree to 50 degrees in the hardness scale Asker C.

As for the material for the foamed elastic portion of the charge roller 2, EPDM urethane, NBR, silicone rubber, IR, and the like, can be listed. Into these materials, a cross-linking agent, a foaming agent (water, a substance with a low boiling point, a gaseous substance, or the like), a surfactant, a catalyst, and the like, are mixed in known proportions in which the structure of the foamed elastic layer, into which the mixture will be formed, is likely to form cells that are connected to only some of the adjacent cells. Further, for the adjustment of the electrical resistance, electrically conductive particles, such as carbon black or metallic oxide are dispersed into the above-described reactive mixture. Instead of the dispersion of electrically conductive substance, an ion conductive substance may be employed to adjust the electrical resistance. The thus produced foamable material is guided into a mold, and is made to foam therein, forming the foamed elastic layer in which cells are connected to only some of the adjacent cells, and the electrical resistance of which is in the mid range.

The charge roller 2 is placed in contact with the photoconductive drum 1, as an object to be charged, with the application of a predetermined amount of pressure, forming a charging nip between the charge roller 2 and photoconductive drum 1, since the charge roller 2 is elastic. The width of the charging nip in this embodiment was 3 mm.

Also in this embodiment, the charge roller 2 was rotationally driven at approximately 80 rpm, in the clockwise direction, so that the peripheral surfaces of the charge roller 2 and photoconductive drum 1 moved in the opposite directions relative to each other, at approximately the same velocities, in the charging nip n. In other words, the charge roller 2 was rotated so that a certain amount of difference in velocity was provided between the peripheral surface of the charge roller 2 and the peripheral surface of the photoconductive drum 1 as an object to be charged.

Further, a DC voltage of −700 V was applied as charge bias to the metallic core 2*a* of the charge roller 2 from the charge bias application power source S1.

(3) Developing Device 4

The developing device 4 in this embodiment is a reversal-development-type developing device which employs a single component magnetic toner (negative toner) as developer t.

Reference numeral 4*a* stands for a rotational non-magnetic development sleeve, functioning as a developer bearing/conveying member, in the hollow of which a magnetic roll 4*b* is disposed. The developer t is coated in a thin layer on the peripheral surface of the rotational development sleeve 4*a* with the use of a regulating blade 4*c*.

As the layer of the developer t on the peripheral surface of the rotational development roller 4*a* is regulated in thickness by the regulating blade 4*c*, an electrical charge is given to the developer t.

As the rotational sleeve 4*a* is rotated, the developer coated on the sleeve 4*a* is conveyed to the developing portion a (development area) where the peripheral surfaces of the photoconductive drum 1 and sleeve 4*a* oppose each other. To the sleeve 4*a*, a development bias voltage is applied from the development bias application power source S2. As the development bias voltage, a combination of a DC voltage of −500 V, and an AC voltage having a frequency of 1,800 Hz, a peak-to-peak voltage of 1,600 V, and a rectangular waveform, is used. With the application of this development bias voltage, the electrostatic latent image on the peripheral surface of the photoconductive drum 1 is developed by the toner.

The developer t, which is single component magnetic toner, contains a binding agent, magnetic particles, and an electrical charge controlling agent. In production, these ingredients are mixed, kneaded, pulverized, and classified, and then, to the thus obtained particles, a fluidizing agent or the like is added to obtain the final product, or the single component magnetic toner. The weight average particle diameter (D4) of the toner was 7 μm.

In this embodiment, two parts by weight of electrically conductive particles m2 was added, as charging-performance-enhancing particles, to 100 parts by weight of the above-described developer t.

(4) Movement of Developer t and Electrically Conductive Particles onto Photoconductive Drum 1

In the developing portion a, the electrically conductive particles m2, added in an amount of 2% by weight to the developer t in the developing device 4 move by a proper amount onto the photoconductive drum 1 together with the toner particles, as the electrostatic latent image on the photoconductive drum 1 is developed by the toner.

In the transfer nip b, the toner image on the photoconductive drum 1 is pulled, by the effect of the transfer bias, toward the recording medium P, being aggressively transferred onto the recording medium P. In comparison, the electrically conductive particles m2 on the photoconductive drum 1 do not aggressively transfer onto the recording medium P, remaining adhered to the photoconductive drum 1, in practical terms, because they are electrically conductive.

Because the printer is of a cleanerless type, the above-described electrically conductive particles m2 remaining on the peripheral surface of the photoconductive drum 1 after the toner-image transfer are conveyed to the charging nip n, that is, the nip between the photoconductive drum 1 and charge roller 2, by the movement of the peripheral surface of the photoconductive drum 1, and adhere to the charge roller 2, that is, they are supplied to the charge roller 2.

In other words, even if the electrically conductive particles fall off the charge roller 2, the electrically conductive particles m2 contained in the developer t in the developing device 4 are continuously supplied to the charge roller 2. More specifically, as the printer is operated, the electrically conductive particles m2 move onto the peripheral surface of the photoconductive drum 1, in the developing portion a, and are conveyed by the movement of the peripheral surface of the photoconductive drum 1 through the transfer nip b and to the charging nip n, in which they are supplied to the charge roller 2.

Those electrically conductive particles m2 which fell off the charge roller 2 are recovered by the developing device 4, in which they are mixed into the developer t to be recycled.

Also, because the printer is of a cleanerless type, the transfer residual toner particles remaining on the peripheral surface of the photoconductive drum 1 after the toner-image transfer are conveyed, as they are, by the movement of the peripheral surface of the photoconductive drum 1 to the charging nip n, or the interface between the photoconductive drum 1 and the charge roller 2, in which they adhere to, and/or enter, the charge roller 2. Even when the transfer residual toner particles adhere to and/or enter the charge roller 2 as described above, the presence of the electrically conductive particles m1 and m2 in the charging nip n, that is, the nip between the photoconductive drum 1 and charge roller 2, makes it possible to maintain a proper amount of contact resistance between the charge roller 2 and photoconductive drum 1, while keeping the charge roller 2 in contact with the photoconductive drum 1 with virtually no gap between them even at the microscopic level. Therefore, in spite of the contamination of the charge roller 2 by the transfer residual toner particles, the charge roller 2 is allowed to directly and reliably inject electrical charge into the photoconductive drum 1 for a long period of time; in other words, the charge roller 2 can uniformly charge the photoconductive drum 1, without generating ozone, for a long period of time.

As described above, the charge roller 2 and the photoconductive drum 1 are rotated in contact with each other, with the presence of a certain amount of difference in velocity between the peripheral surfaces of the charge roller 2 and the photoconductive drum 1. Therefore, as the transfer residual toner particles from the transfer nip b reach the charging nip n, they are aggressively stirred, losing the pattern in which they were adhering to the photoconductive drum 1. Therefore, the image pattern formed on the photoconductive drum 1 during the preceding rotational cycle of the photoconductive drum 1 does not cause the production of a ghost image across the halftone area of the image being currently formed.

After adhering to, and/or entering the charge roller 2, the transfer residual toner particles are gradually expelled from the charge roller 2 onto the photoconductive drum 1. Then, as the peripheral surface of the photoconductive drum 1 moves, they reach the developing portion a, in which they are recovered (removed from the photoconductive drum 1) by the developing means at the same time as the latent image on the peripheral surface of the photoconductive drum 1 is developed by the developing means.

As described before, the "developing/cleaning process" is a process in which the toner particles remaining on the photoconductive drum 1 after the toner-image transfer are recovered by the developing device, with the use of the fog prevention bias, that is, the difference Vback in the potential level between the potential level of the DC voltage applied to the developing device and the potential level of the peripheral surface of the photoconductive drum 1, during the development of the latent image formed during the following rotational cycle of the photoconductive drum 1. More specifically, as the rotation of the photoconductive drum 1 continues, the portion of the peripheral surface of the photoconductive drum 1 across which the transfer residual toner particles remain, is charged, and is exposed to form a latent image on the peripheral surface of the photoconductive drum 1, with the presence of the transfer residual toner particles thereon. Then, the transfer residual toner particles are removed while this latent image is developed. In the case of a printer which develops a latent image in reverse as does the printer in this embodiment, this developing/cleaning process is carried out by the electric field which strips toner particles from the dark potential level portions of the photoconductive member and adheres them onto the development sleeve (recovery), and the electric field which strips toner particles from the development sleeve and adheres them to the light potential level portions of the photoconductive member.

(5) Electrically Conductive Particles m1 and m2

In this embodiment, electrically conductive zinc oxide particles, which are $10^6$ Ω·cm in resistivity, and 3 μm in average particle diameter, are used as the electrically conductive particles m1 coated in advance as charging-performance-enhancing particles on the peripheral surface of the charge roller 2.

For the purpose of uniformly charging the peripheral surface of the photoconductive drum 1, the particle diameter of the electrically conductive particles is desired to be smaller, more concretely, no more than 10 μm. Preferably, the particles are no smaller than 10 nm in average particle diameter, and no greater than a single picture element in size.

In order for electrical charge to be efficiently given or received through the electrically conductive particles, the electrical resistance of the particles is desired to be no more than $10^{12}$ Ω·cm, preferably, no more than $10^{10}$ Ω·cm. Further, the resistivity of the particles is desired to be no less than $10^2$ Ω·cm.

It does not matter at all whether the charging-performance-enhancing particles are in a primary state, that is, independent from each other, or in a secondary state, that is, in an agglomerated state.

In this embodiment, electrically conductive particles similar to the electrically conductive particles m1 coated in advance on the charge roller 2 are used as the electrically conductive particles m2 mixed, as charging-performance-enhancing particles, into the developer.

If the electrically conductive particles m2 are too small in particle diameter, the toner particles are covered with electrically conductive particles m2 which are low in electrical resistance. Therefore, the toner particles fail to be sufficiently charged by friction, failing to satisfactorily develop a latent image. On the contrary, if the particle diameter of the electrically conductive particles m2 is too large, the electrically conductive particles m2 block the exposure light. Further, they make the finished image look inferior; the electrically conductive particles m2 stand out among the toner particles, causing the toner image, that is, the developed latent image, to appear irregular. Thus, the particle diameter of the electrically conductive particles to be added to the developer is desired to be no less than 0.1 μm, and is smaller than the particle diameter of the toner.

The aforementioned electrically conductive particles, which are present in the charging nip n, that is, the nip between the photoconductive drum 1 as an object to be charged, and the charge roller 2 as a contact charging member, function as a lubricant. Therefore, with the presence of the electrically conductive particles in the charging nip, even a charge roller, which is difficult to rotate in contact with the photoconductive drum 1, while maintaining a predetermined amount of difference in peripheral velocity between the charge roller 2 and photoconductive drum 1, because of the frictional resistance, can be easily rotated in contact with the photoconductive drum 1 while maintaining a predetermined amount of difference in peripheral velocity between the charge roller 2 and photoconductive drum 1.

With the provision of the predetermined amount of difference in peripheral velocity between the charge roller 2 and photoconductive drum 1, the frequency at which the electrically conductive particles m1 and m2 make contact with the photoconductive drum 1, in the nip between the charge roller 2 and photoconductive drum 1, can be drastically increased, and also, the peripheral surfaces of the charge roller 2 and photoconductive drum 1 can be kept in contact with each other with the presence of virtually no gaps between them. Further, those electrically conductive particles m1 and m2 which are in the nip between the charge roller 2 and photoconductive drum 1 rub the peripheral surface of the photoconductive drum 1 without missing even a single spot, allowing electrical charge to directly and efficiently be injected into the photoconductive drum 1. Thus, when the photoconductive drum 1 is charged with the use of the charge roller 2, in other words, when the photoconductive drum 1 is charged using a contact charging method, with the presence of the electrically conductive particles m1 and m2 in the nip between the charge roller 2 and photoconductive drum 1, the direct charge injection is the dominant charging mechanism.

(6) Photoconductive Member 1

In this embodiment, for the purpose of reducing the friction between the charging-performance-enhancing particles and the peripheral surface of an object to be charged, and also, adjusting the surface resistance of the object to be charged, to reliably and uniformly charge the photoconductive member 1, the peripheral surface of the photoconductive member 1, as an object be charged, in the first embodiment, was coated with a charge injection layer.

Figure 3:
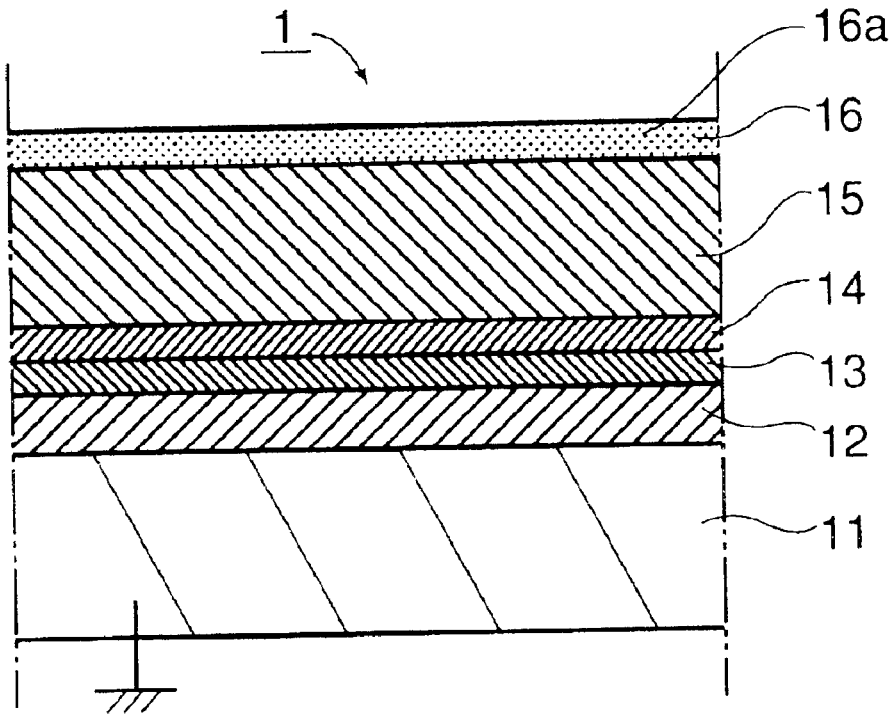
FIG. 3 is an enlarged schematic sectional view of the peripheral portion of the photoconductive member with a charge injectable surface layer, for showing the laminar structure thereof.

FIG. 3 is a schematic sectional view of the peripheral portion of the photoconductive member 1 used in this embodiment, the surface layer of which is a charge-injection layer 16, and shows the laminar structure thereof. As is evident from the drawing, this photoconductive member 1 comprises an ordinary organic photoconductive drum, and the charge-injection layer 16 placed on the peripheral surface of the ordinary organic photoconductive drum in order to improve the charging performance of the ordinary organic photoconductive drum. Incidentally, an ordinary organic photoconductive drum is produced by coating on the peripheral surface of an aluminum base member 11 (Al drum), an undercoating layer 12, a positive charge-blocking layer 13, a charge-generation layer 14, and a charge-transfer layer 15, in the listed order.

The charge-injection layer 16 contains photo-curable acrylic resin as binder, microscopic particles 16*a* (approximately 0.03 $\mu$m in diameter) of tin oxide ($SnO_2$) as electrically conductive particles (electrically conductive filler), lubricant such as tetrafluoroethylene resin (commercial name: Teflon), polymerization initiator, and the like. These ingredients are mixed well, coated on the peripheral surface of the ordinary organic photoconductive member, and are photo-cured into a layer of film.

The most important aspects of the charge-injection layer 16 are the surface resistance and surface energy. In a charging method in which electrical charge is directly injected, reducing the electrical resistance on the side to be charged makes it possible to more efficiently exchange electrical charge. On the other hand, when the object to be charged is an image bearing member (photoconductive member), the object to be charged must be able to retain an electrostatic latent image for a certain length of time. Therefore, the proper range for the volumetric resistivity value of the charge-injection layer 16 is $1\times10^{9}$–$1\times10^{14}$ ($\Omega\cdot$cm).

The presence of lubricant in the charge-injection layer 16 reduces the surface energy of the object to be charged (photoconductive member), making it easier for the toner to move onto the transfer medium, and also, making it harder for paper dust to adhere to the object to be charged. Therefore, the contamination of the contact charging member by toner and paper dust is reduced, prolonging the period in which the charging roller performs at or above the satisfactory level. Further, the presence of lubricant in the charge-injection layer 16 reduces the frictional force between the charging-performance-enhancing particles and the object to be charged, considerably reducing the amount by which the object to be charged is shaved.

As described above, providing a photoconductive member with a charge-injection layer as its surface layer assures that electrical charge can be directly injected into the photoconductive member, with a high level of efficiency, for a long period of time, with the use of the charging apparatus in this embodiment.

COMPARATIVE EXAMPLE 1

The contact charging member in the printer in this first comparative example was only slightly different from the contact charging member of the printer in first embodiment. More specifically, the charge roller 2 in this comparative example comprised a metallic core, and a foamed elastic layer 2*b*' wrapped around the metallic core. The foamed elastic layer 2*b*' was formed of urethane in which carbon particles had been dispersed, and its electrical resistance was in the mid range, like the foamed elastic layer in the first embodiment. However, in this comparative example, cells in the foamed elastic layer 2*b*' were interconnected (FIG. 5), and the air flow quantity of the foamed elastic layer 2*b*', which was measured in the following manner, was 150/cm$^2$ min: a 25 mm piece, in terms of the axial direction, of the foamed elastic layer was cut as a test piece 17 (FIG. 2) from the foamed elastic layer 2*b*', and the air flow quantity was measured, with one end of the test piece 17 exposed to the ambient environment, whereas the other end was connected to a chamber, the internal pressure of which was kept 100 mHG lower than the atmospheric pressure. Otherwise, the printer in this comparative example was the same as the printer in the first embodiment.

COMPARATIVE EXAMPLE 2

The printer in this second comparative example was also only slightly different from the printer in the first embodiment because their contact charging members were different. More specifically, the charge roller 2 in this comparative example comprised a metallic core, and a foamed elastic layer 2*b*" wrapped around the metallic core. The foamed elastic layer 2*b*" was formed of silicone rubber in which carbon particles had been dispersed, and its electrical resistance was in the mid range. Cells in the foamed elastic layer were discrete (FIG. 6), and the air flow quantity of the foamed elastic layer 2*b*", which was measured in the following manner, was 0/cm$^2$ min: a 25 mm piece, in terms of the axial direction, of the foamed elastic layer was cut as a test piece 17 (FIG. 2) from the foamed elastic layer, and the air flow quantity was measured, with one end of the test piece 17 exposed to the ambient environment, whereas the other end was connected to a chamber, the internal pressure of which was kept 100 mHG lower than the atmospheric pressure. Otherwise, the printer in this comparative example was the same as the printer in the first embodiment.

(Evaluations)

1. Image Defect Evaluation

The above-described first embodiment, and the first and second comparative examples, were evaluated regarding image defects. The results are summarized in Table 1.

The evaluations were made after a grid pattern with a cell size of 1 cm×1 cm was printed on the 2,000th and 5,000$^{th}$ copy of A4 size ordinary paper, the paper was positioned so that the longer edges of the paper became perpendicular to the direction in which the papers were conveyed.

For the image-defect evaluation, halftone images were outputted, and the images were evaluated based on the number of defects in the form of a black spot and a white spot. For the formation of images, the image forming apparatuses were used with a laser scanner with a resolution of 600 dpi. In these evaluations, the term "halftone image" refers to an image, the density of which was effected by a stripe pattern formed by printing a line for every third raster line in terms of the primary scanning direction.

In this evaluation, images were formed using a reversal developing system. Therefore, when the exposure light aimed at a given point of the peripheral surface of the photoconductive member was blocked, this point appeared as a white spot in an image. Thus, images were evaluated based on the number of white spots, or defective spots, using the following standard.

NG: no fewer than 30 white spots with a diameter of no more than 0.3 mm were present in a halftone image.

G: 6–9 white spots with a diameter of no more than 0.3 mm were present in the halftone image.

E: no more than 5 white spots with a diameter of no more than 0.3 mm were present in the halftone image.

Also, due to the employment of the reversal development system, any point of the peripheral surface of the photoconductive member which was prevented from being charged appeared as a black spot. Thus, images were also evaluated based on the number of black spots, or defective spots, using the following standard.

NG: no fewer than 30 black spots with a diameter of no more than 0.3 mm were present in the halftone image.

G: 6–9 black spots with a diameter of no more than 0.3 mm were present in the halftone image.

E: no more than 5 black spots with a diameter of non more than 0.3 mm were present in the halftone image.

TABLE 1

| | 2000 sheets | | 5000 sheets | |
|---|---|---|---|---|
| No. of prints | White dots | Black dots | White dots | Black dots |
| Emb. 1 | E | E | E | E |
| Emb. 2 | E | E | E | G |
| Emb. 3 | NG | E | NG | E |

In the case of the first embodiment, virtually no image defects were found in the halftone image, even after 2,000 or 5,000 copies were printed with the grid pattern. The reason virtually no image defects appeared is as follows:

The foamed elastic portion 2*b* of the charge roller 2, in which cells are connected to only some of the adjacent cells, displayed the characteristics of the foamed material in which all cells were interconnected, being therefore superior in particle-retaining ability. Thus, the charge roller 2 could temporarily store the transfer residual toner particles, and gradually expel the stored transfer residual toner particles onto the photoconductive drum 1. Therefore, the transfer residual toner particles on the photoconductive drum 1 rarely blocked the exposure light. As a result, virtually no white spots, or image defects, showed up in the halftone image.

Further, this foamed elastic portion 2*b*, also displayed the characteristics of the foamed material in which all cells were discrete, that is, none of the cells were interconnected, making it harder for the foamed elastic portion 2*b* to take in the fibrous paper dust. Therefore, in spite of the increase in the number of the printed copies, a substantial amount of paper dust was not accumulated on, or in, the charge roller 2, and therefore, it rarely occurred that the transfer residual toner particles agglomerated around the paper dust, on the peripheral surface of the charge roller 2. Consequently, the charge roller 2 remained virtually free of the contamination by the paper dust; it remained in good condition. Thus, virtually no black spots appeared in the halftone image.

In the case of the first comparative example, after the printing of 2,000 copies, virtually no image defects were found in the halftone image. However, after the printing of 5,000 copies, black spots, or image defects, were found in the halftone image. The reason for this problem is as follows. In the foamed elastic portion 2*b*' of the charge roller in the first comparative example, cells were interconnected, making it easier for the charge roller to take in the fibrous paper dust. Therefore, as the number of the printed copies increased, the paper dusts was accumulated on, or in, the charge roller, causing the various points of the peripheral surface of the photoconductive member to be insufficiently charged. However, in the case of the first comparative example, virtually no image defects in the form of a white spot appeared, for the following reason. In the foamed elastic portion 2*b*' in this comparative example, the cells were interconnected. Thus, the transfer residual toner particles on the peripheral surface of the photoconductive member rarely blocked the exposure light. As a result, virtually no image defects in the form of a white spot appeared in the halftone image.

In the case of the second comparative example, the image defects in the form of a white spot appeared in the halftone image, after the printing of 2,000 copies, and also after the printing of 5,000 copies. In this case, the cells in the foamed elastic portion 2*b*" of the charge roller were discrete. Therefore, the charge roller expelled the transfer residual toner particles all at once onto the peripheral surface of the photoconductive member. As a result, the image defects in the form of a white spot appeared in the halftone image. However, in the case of the second comparative example, virtually no image defects in the form of a black spot appeared. This was because the cells in the foamed elastic portion 2*b*" were discrete. Thus, the charge roller did not collect paper dust. As a result, virtually no image defects in the form of a black spot appeared in the halftone image.

2. Evaluation of Fog across Solid White Area

The printers in the above-described first embodiment, and first and second comparative examples, were evaluated regarding the toner fog across the solid white area. The summary of the results is given in Table 2.

The evaluation of the toner fog across a solid white image was made in the following manner: After a grid pattern with a cell size of 1 cm×1 cm was printed on the 2,000th and 5,000th copy of A4 size ordinary paper, an image pattern with a print ratio of 20%, made up of writing characters, was printed, and the paper was positioned so that the longer edges of the paper became perpendicular to the direction in which the papers were conveyed, and immediately thereafter, a solid white image was printed. Then, this solid white image was evaluated for toner fog.

The solid white image was evaluated in the following manner. The reflectance of 10 randomly selected points on a sheet of printing paper before it was passed through the printer, and the reflectance of 10 randomly selected points on a sheet of printing paper on which a solid white image was printed, were measured, with the use of a reflection-type densitometer. Then, an evaluation was made based on the difference in reflectance between the smallest reflectance value obtained from the former printing paper, and the smallest reflectance value obtained from the latter printing paper. The reflectance of a sheet of paper which was measured without passing it through the printer, and the reflectance of the paper, on which a solid white image was to be printed, which was measured before the solid white image was printed, were virtually the same.

The thus obtained reflectance differences were evaluated based on the following criteria:

NG: the difference in reflectance was no less than 2.0%;

G: the difference in reflectance was no less than 1.0% but no more than 2.0%;

E: the difference in reflectance was no more than 1.0%.

TABLE 2

| No. of prints | 2000 sheets | 5000 sheets |
|---|---|---|
| Emb. 1 | G | E |
| Comp. Ex. 1 | G | G |
| Comp. Ex. 2 | NG | NG |

In the case of the first embodiment, virtually no toner fog was found in the solid white image, even after 2,000 and 5,000 copies of the grid pattern were printed. This is for the following reason: the foamed elastic portion 2*b*, in which cells were connected to only some of the adjacent cells, displayed the characteristics of the formed material in which all cells were interconnected, being therefore superior in particle-retaining ability. Thus, the charge roller 2 could temporarily store the transfer residual toner particles, and gradually expel the stored transfer residual toner particles onto the photoconductive member. As a result, virtually all the residual toner particles on the photoconductive member were recovered by the developing device.

In the case of the first comparative example, even after 2,000 and 5,000 copies of the grid pattern were printed, virtually no toner fog appeared, for the following reason. In the foamed elastic portion 2*b*' in this comparative example, the cells are interconnected. Therefore, the charge roller was superior in the particle-retaining ability. Therefore, the charge roller could temporarily store the transfer residual toner particles.

In the case of the second comparative example, toner fog was found in the solid white image, after the printing of 2,000 copies, and also after the printing of 5,000 copies. In this case, the cells in the foamed elastic portion 2*b*" of the charge roller were discrete. Therefore, the charge roller was inferior in particle-retaining ability, failing to temporarily store the transfer residual toner particles. Therefore, the charge roller expelled the transfer residual toner particles all at once onto the peripheral surface of the photoconductive member. As a result, there were too many transfer residual toner particles for the developing device to recover.

(Miscellanies)

1) The charge bias applied to an elastic charging member may be such a charge bias that comprises an alternating voltage component (AC component: voltage, the value of which periodically changes). The waveform of the alternating voltage component is optional; it may be sinusoidal, rectangular, triangular, or the like. It may be such a rectangular waveform that is formed by periodically turning on or off a DC power source.

2) The image-exposing means, as a means for writing image-formation data on the charged surface of a photoconductive member, as an image bearing member, of an image forming apparatus may be a digital exposing means employing a solid light emitting diode such as an LED, instead of the laser scanning means in the first embodiment. It also may be an analog image exposing means employing a halogen lamp, a fluorescent light, or the like, as an original illuminating light source. To sum up, any means will suffice as long as it is capable of forming an electrostatic latent image which accurately reflects image-formation data.

3) An image bearing member may be an electrostatically recordable dielectric member. In the case of an electrostatically recordable dielectric member, its surface is uniformly charged, and the uniformly charged surface is selectively discharged with the use of a charge-removing means, such as a charge-removing needle head, an electron gun, or the like, to write an electrostatic latent image that accurately reflects the image-formation data of an intended image.

4) The choice of a method and a means of an image forming apparatus for developing an electrostatic latent image with the use of toner is optional; it may be a normal developing method, or a reverse developing method.

Generally speaking, the methods for developing an electrostatic latent image are roughly divided into four groups: a single component/noncontact developing method group, a single component/contact developing method group, a two component/contact developing method group, and a two component/noncontact developing method group. In the case of the single component/noncontact developing method group, when non-magnetic toner is used, it is coated on a developer bearing/conveying member, such as a development sleeve, with the use of a blade or the like, whereas magnetic toner is coated on a developer bearing/conveying member with the use of magnetic force. Then, an electrostatic latent image is developed by transferring the developer on the developer bearing/conveying member, onto an image bearing member, with no contact between the developer bearing/conveying member and the image bearing member. In the case of the single component/contact developing method group, an electrostatic latent image is developed by transferring the toner coated on the developer bearing/conveying member as it is in the case of the single component/noncontact developing method group, onto an image bearing member, with the presence of contact between the developer bearing/conveying member and the image bearing member. In the case of the two component/contact developing method group, a mixture of toner particles and magnetic carrier particles is used as developer (two component developer), and the two component developer is coated on a developer bearing/conveying member with the use of magnetic force. Then, an electrostatic latent image is developed by transferring the two component developer on the developer bearing/conveying member, onto an image bearing member, with the presence of contact between the developer bearing/conveying member and image bearing member. Lastly, in the case of the two component/noncontact developing method group, the above-described two component developer is transferred onto an image bearing member, with no contact between the developer bearing/conveying member and the image bearing member. Any of these developing methods is compatible with an image forming apparatus in accordance with the present invention.

As described above, according to the present invention, a foamed elastic substance in which cells are connected to only some of the adjacent cells, is used as the material for the elastic layer portion of a contact charging member. Therefore, the contact charging member is not contaminated by fibrous paper dust, and is also enabled to temporarily store the transfer residual toner particles. Being free of fibrous paper dust, the contact charging member is enabled to directly inject electrical charge into an image bearing member, with a high level of efficiency, for a long period time. Therefore, the contact charging member can more uniformly charge an image bearing member, without generating ozone, for a long period of time, while requiring a charge voltage of a substantially lower potential level compared to the charge voltage required by a contact charging member based on the prior art. Therefore, high quality images, that is, images in which the halftone areas do not show the signs of non-uniform charging of the image bearing member, can be outputted for a long period of time. Further, since the contact charging member is enabled to temporarily store the transfer residual toner particles, high quality images, that is, images in which even the solid white areas do not sustain toner fog, can be outputted for a long period of time.

While the invention has been described with reference to the structures disclosed herein, it is not confined to the details set forth, and this application is intended to cover such modifications or changes as may come within the purposes of the improvements or the scope of the following claims.

What is claimed is:

1. A charging member for charging a member to be charged, comprising:

an elastic foam member provided at a surface of said charging member, said elastic foam member including a plurality of cell portions with a wall portion defining the cell portions, wherein the gap ratio of the projected area of a gap connecting each cell portion to another cell portion to the projected area of the cell portion is not less than 5% and not more than 50%.

2. A charging member according to claim 1, wherein said elastic foam member has such a property that when one side of said elastic foam member is placed in an ambient pressure condition, and the other side is placed under a pressure which is lower by 13.3 kPa than the ambient pressure, the air flow rate is not less than 1 $cc/cm^2$ min and not more than 100 $cc/cm^2$ min.

3. A charging member according to claim 1, wherein the member to be charged is charged by said elastic foam member being pressed by the member to be charged while electroconductive particles are carried on a surface of said elastic foam member.

4. A charging member according to claim 3, wherein the surface of said charging member moves at a peripheral speed which is different from the peripheral speed of the member to be charged.

5. A charging member according to claim 3, wherein the member to be charged is an image bearing member configured and positioned to carry an image, and the electroconductive particles have particle sizes which are not less than 10 nm and not more than the size of one pixel of the image.

6. A charging member according to claim 3, wherein the electroconductive particles have a volume resistivity of not more than $1\times10^{12}$ Ωcm.

7. A charging member according to claim 1, wherein said charging member has an electrode member configured and positioned to receive a voltage.

8. A charging member according to claim 1, wherein said charging member is in the form of a roller.

9. A charging member according to claim 1, wherein said charging member effects injection charging to the member to be charged.

10. A charging apparatus comprising:

a charging member configured and positioned to charge a member to be charged, wherein said charging member is provided with an elastic foam member provided at a surface thereof, and a nip portion is formed between the member to be charged and said elastic foam member, wherein electroconductive particles are provided in the nip portion, and wherein said elastic foam member includes a plurality of cell portions with a wall portion defining the cell portions, wherein the gap ratio of the projected area of a gap connecting each cell portion to another cell portion to the projected area of the cell portion is not less than 5% and not more than 50%.

11. An apparatus according to claim 10, wherein said elastic foam member has such a property that when one side of said elastic foam member is placed in an ambient pressure condition and the other side is placed under a pressure which is lower by 13.3 kPa than the ambient pressure, the air flow rate is not less than 1 $cc/cm^2$ min and not more than 100 $cc/cm^2$ min.

12. An apparatus according to claim 10, wherein the member to be charged is charged by said elastic foam member being pressed by the member to be charged while the electroconductive particles are carried on a surface of said elastic foam member.

13. An apparatus according to claim 12, wherein a surface of said charging member moves at a peripheral speed which is different from a peripheral speed of the member to be charged.

14. An apparatus according to claim 12, wherein said charging member and the member to be charged move in directions opposite from an ejection outlet at the nip portion.

15. An apparatus according to claim 12, wherein the member to be charged is an image bearing member for carrying an image, and the electroconductive particles have particle sizes which are not less than 10 nm and not more than a size of one pixel of the image.

16. An apparatus according to claim 12, wherein the electroconductive particles have a volume resistivity of not more than $1\times10^{12}$ Ωcm.

17. An apparatus according to claim 10, wherein said charging member has an electrode member configured and positioned to receive a voltage.

18. An apparatus according to claim 10, wherein said charging member is in the form of a roller.

19. An apparatus according to claim 10, wherein said charging member effects injection charging in the nip portion.

20. A process cartridge detachably mountable to a main assembly of an image forming apparatus, said process cartridge comprising:

an image bearing member; and a charging member positioned and configured to charge said image bearing member, wherein said charging member is provided with an elastic foam member provided at a surface thereof, and a nip is formed between the member to be charged and said elastic foam member, wherein electroconductive particles are provided in the nip portion, wherein said elastic foam member includes a plurality of cell portions with wall portion defining the cell portions, and wherein the gap ratio of the projected area of a gap connecting each cell portion to another cell portion to the projected area of the cell portion is not less than 5% and not more than 50%.

21. A process cartridge according to claim 20, wherein said image bearing member has a surface layer having a volume resistivity of $10^9$–$10^{14}$ Ω.

22. A process cartridge according to claim 21, wherein said surface layer comprises a light transmitting insulative binder, a lubricant and the electroconductive particles.

23. A process cartridge according to claim 20, further comprising developing means for developing an electrostatic image formed on said image bearing member with a developer, wherein said developing means supplies the electroconductive particles to said image bearing member, and the electroconductive particles are fed to the nip portion by said image bearing member.

24. A process cartridge according to claim 23, wherein said developing means is capable of collecting the developer from said image bearing member.

25. An image forming apparatus comprising:

an image bearing member; and a charging member configured and positioned to charge a member to be charged, wherein said charging member is provided with an elastic foam member provided at a surface thereof, and a nip portion is formed between the member to be charged and said elastic foam member, and wherein electroconductive particles are provided in the nip portion; and electrostatic image forming means for forming an electrostatic image on said image bearing member;

wherein said elastic foam member includes a plurality of cell portions with a wall portion defining the cell portions, wherein the gap ratio of the projected area of a gap connecting each cell portion to another cell portion to the projected area of the cell portion is not less than 5% and not more than 50%.

26. An apparatus according to claim 25, wherein said image bearing member has a surface layer having a volume resistivity of $10^9$–$10^{14}$ Ω.

27. An apparatus according to claim 25, wherein said image bearing member has a surface layer, and wherein said surface layer comprises a light transmitting insulative binder, a lubricant and said electroconductive particles.

28. An apparatus according to claim 25, further comprising developing means for developing an electrostatic image formed on said image bearing member with a developer, wherein said developing means supplies said electroconductive particles to said image bearing member, and said electroconductive particles are fed to the nip portion by said image bearing member.

29. An apparatus according to claim 28, wherein said developing means is capable of collecting the developer from said image bearing member.

* * * * *